US011846143B2

(12) United States Patent
Marr et al.

(10) Patent No.: US 11,846,143 B2
(45) Date of Patent: Dec. 19, 2023

(54) CENTRALIZER

(71) Applicant: LORD Corporation, Cary, NC (US)

(72) Inventors: Conor Marr, Erie, PA (US); Zackary Leicht, Cranesville, PA (US)

(73) Assignee: LORD Corporation, Cary, NC (US)

( * ) Notice: Subject to any disclaimer, the term of this patent is extended or adjusted under 35 U.S.C. 154(b) by 261 days.

(21) Appl. No.: 17/433,330

(22) PCT Filed: Mar. 4, 2020

(86) PCT No.: PCT/US2020/020883
§ 371 (c)(1),
(2) Date: Aug. 24, 2021

(87) PCT Pub. No.: WO2020/180926
PCT Pub. Date: Sep. 10, 2020

(65) Prior Publication Data

US 2022/0145708 A1 May 12, 2022

Related U.S. Application Data

(60) Provisional application No. 62/813,327, filed on Mar. 4, 2019.

(51) Int. Cl.
*E21B 17/10* (2006.01)

(52) U.S. Cl.
CPC ..... *E21B 17/1078* (2013.01)

(58) Field of Classification Search
CPC ..... E21B 17/1078; E21B 17/1071; E21B 17/1042; E21B 17/1014; E21B 17/105
See application file for complete search history.

(56) References Cited

U.S. PATENT DOCUMENTS 4,156,374 A * 5/1979 Shwayder ..... F16L 57/06 175/325.2
4,729,438 A * 3/1988 Walker ..... E21B 17/22 175/325.2

(Continued)

FOREIGN PATENT DOCUMENTS

EP 3 141 688 A1 3/2017
WO WO-2010109229 A2 * 9/2010 ..... E21B 17/1078

(Continued)

OTHER PUBLICATIONS

Canadian Office Action for Application No. 3131793 dated Nov. 23, 2022.

(Continued)

*Primary Examiner* — Kenneth L Thompson
(74) *Attorney, Agent, or Firm* — KDW FIRM PLLC

(57) ABSTRACT

A system has a fin with an upstream end, a downstream end, a wall interface (412), a carrier interface (414) offset from the wall interface (412) in a radially inward direction, and an impact surface (418). The impact surface extends between an upstream end of the wall interface and an upstream end of the carrier interface. The impact surface (418) has a substantially flat portion configured to cause flow stagnation. The fin (306) has a side surface (416) extending between the impact surface (418), the wall interface (412), and the carrier interface. The impact surface (418) is joined to the side surface (416) by an edge profile (420) configured to cause turbulence or separation of the fluid flow from the fin.

23 Claims, 27 Drawing Sheets

(56) References Cited

U.S. PATENT DOCUMENTS

| | | | | |
|---|---|---|---|---|
| 5,487,426 | A * | 1/1996 | O'Hair | E21B 17/1071 166/378 |
| 5,492,174 | A * | 2/1996 | O'Hair | E21B 17/1042 166/378 |
| 10,100,588 | B2 * | 10/2018 | Angman | E21B 17/16 |
| 10,502,007 | B2 * | 12/2019 | Gao | E21B 17/1078 |
| 10,632,713 | B2 * | 4/2020 | Walker | B32B 3/30 |
| 10,738,546 | B2 * | 8/2020 | Rutledge | E21B 17/1007 |
| 10,900,297 | B2 * | 1/2021 | Ong | E21B 17/1078 |
| 10,920,503 | B2 * | 2/2021 | Schlappy | E21B 17/1078 |
| 11,015,440 | B2 * | 5/2021 | Carter | E21B 17/1042 |
| 11,098,537 | B2 * | 8/2021 | Nommensen | E21B 17/1078 |
| 2012/0193089 | A1 | 8/2012 | Makelki et al. | |
| 2018/0112471 | A1 | 4/2018 | Poe et al. | |

FOREIGN PATENT DOCUMENTS

| | | | |
|---|---|---|---|
| WO | WO 2011/002841 | A2 | 1/2011 |
| WO | WO 2013/082376 | A1 | 6/2013 |
| WO | WO 2020/180926 | A1 | 9/2020 |

OTHER PUBLICATIONS

Canadian Office Action for Application No. 3131793 dated May 8, 2023.

International Search Report & Written Opinion for Application No. PCT/2020/020883 dated May 11, 2020.

* cited by examiner

CENTRALIZER

CROSS-REFERENCE TO RELATED APPLICATION

This application claims priority to U.S. Provisional Patent Application No. 62/813,327, filed on 4 Mar. 2019 by Conor Marr, et al., and titled "CENTRALIZER", the disclosure of which is incorporated by reference in its entirety.

FIELD OF INVENTION

The subject matter disclosed herein relates to the design and operation of a centralizer for environments subject to shocks and vibrations as well as highly erosive fluid exposure, such as downhole operations.

BACKGROUND

In some hydrocarbon recovery systems and/or downhole systems, it is desirable to maintain a substantially coaxially centered and laterally constrained position of some downhole components. In some cases, a drill string may be exposed to both repetitive vibrations including a relatively consistent frequency and to vibratory shocks that may not be repetitive. Each of the repetitive vibrations and shock vibrations may damage and/or otherwise interfere with the operation of the electronics, such as, but not limited to, measurement while drilling (MWD) devices and/or logging while drilling (LWD) devices, and/or any other vibration-sensitive device of a drill string. Centralizers comprising centralizer fins are commonly used to help stabilize and center MWD tool strings. The centralizer fins are generally disposed in a highly erosive environment and although there are many geometries and designs of centralizer fins currently in the marketplace, all suffer from low life cycles due to erosion of the fins. Most fin parts are made of an elastomer to provide the needed compliance for a tight fit and lateral stability. However, after the conventional centralizer fins begins to erode, they lose capacity to absorb shocks and to keep the tool string in place.

SUMMARY

According to an example embodiment, a fin for use in a centralizer configured to be disposed in an abrasive fluid flow is provided, the fin comprising: a first end, which is oriented to face in an upstream direction of the abrasive fluid flow; a second end, which is oriented to face in a downstream direction of the abrasive fluid flow; a wall interface, which extends between the first end and the second end, the wall interface being configured as a contact surface of the centralizer to resist radial movements of the centralizer; a carrier interface, which extends between the first end and the second end and is offset from the wall interface in a radially inward direction; an impact surface, which extends between the wall interface and the carrier interface at the first end of the fin and comprises a substantially flat portion configured to stagnate the abrasive fluid flow; and one or more side surfaces, which extends between the impact surface, the wall interface, and the carrier interface; wherein the impact surface is joined to the side surface at an edge having an edge profile configured to cause turbulence and/or separation of the abrasive fluid flow from one or more of the wall interface and the one or more side surfaces of the fin.

In some embodiments of the fin, an angle between the substantially flat portion of the impact surface and a radial line extending orthogonal to a central axis of the centralizer from an end of the wall interface that is furthest in the upstream direction forms an angle within a range of about zero degrees to about fifteen degrees, inclusive.

In some embodiments, the fin is configured to be rigidly attached to a carrier at the carrier interface.

In some embodiments, the fin is configured for attachment to the carrier by a bolt.

In some embodiments, the fin is configured for bonding to the carrier.

In some embodiments, the fin is configured for attachment to the carrier using a compression fit or slip-fit.

In some embodiments, the fin is configured for attachment to the carrier using a thermal fit.

In some embodiments, the fin is configured for attachment to the carrier using a band or a clamp.

In some embodiments, the fin is configured such that the fin and the carrier are integrally formed together.

In some embodiments, the fin comprises a chamfered transition surface between and/or connecting the impact surface and the wall interface.

In some embodiments, the fin comprises an elastomer.

In some embodiments, the fin comprises polyurethane.

In some embodiments, the fin comprises nitrile.

In some embodiments, the fin comprises natural rubber.

In some embodiments, the fin comprises ethylene propylene diene monomer rubber.

In some embodiments, the fin comprises a temperature and fluid resistant synthetic elastomer.

In some embodiments, the fin comprises an internal reinforcement material or reinforcement structure.

According to another example embodiment, at centralizer configured to be disposed in an abrasive fluid flow is provided, the centralizer comprising: a body having a central axis extending along a length of the body; a plurality of fins arranged circumferentially about and attached to the body, at least one of the plurality of fins comprising: a first end, which is oriented to face in an upstream direction of the abrasive fluid flow; a second end, which is oriented to face in a downstream direction of the abrasive fluid flow; a wall interface, which extends between the first end and the second end, the wall interface being configured as a contact surface of the centralizer to resist radial movements of the centralizer; a carrier interface, which extends between the first end and the second end and is offset from the wall interface in a radially inward direction; an impact surface, which extends between the wall interface and the carrier interface at the first end of the fin and comprises a substantially flat portion configured to stagnate the abrasive fluid flow; and one or more side surfaces, which extends between the impact surface, the wall interface, and the carrier interface; wherein the impact surface is joined to the side surface at an edge having an edge profile configured to cause turbulence and/or separation of the abrasive fluid flow from one or more of the wall interface and the one or more side surfaces of the fin.

In some embodiments of the centralizer, the body is tubular and/or in a shape of a hollow cylinder.

In some embodiments of the centralizer, the plurality of fins are arranged to have a substantially uniform fin pitch.

In some embodiments of the centralizer, the centralizer is configured to be installed within an external structure, the wall interface being configured to press against an inner surface of the external structure to resist radial movements of the centralizer.

In some embodiments of the centralizer, the external structure is a borehole.

In some embodiments of the centralizer, each of the plurality of fins comprises the first end, the second end, the wall interface, the carrier interface, the impact surface, and the one or more side surfaces.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

Figure 1:
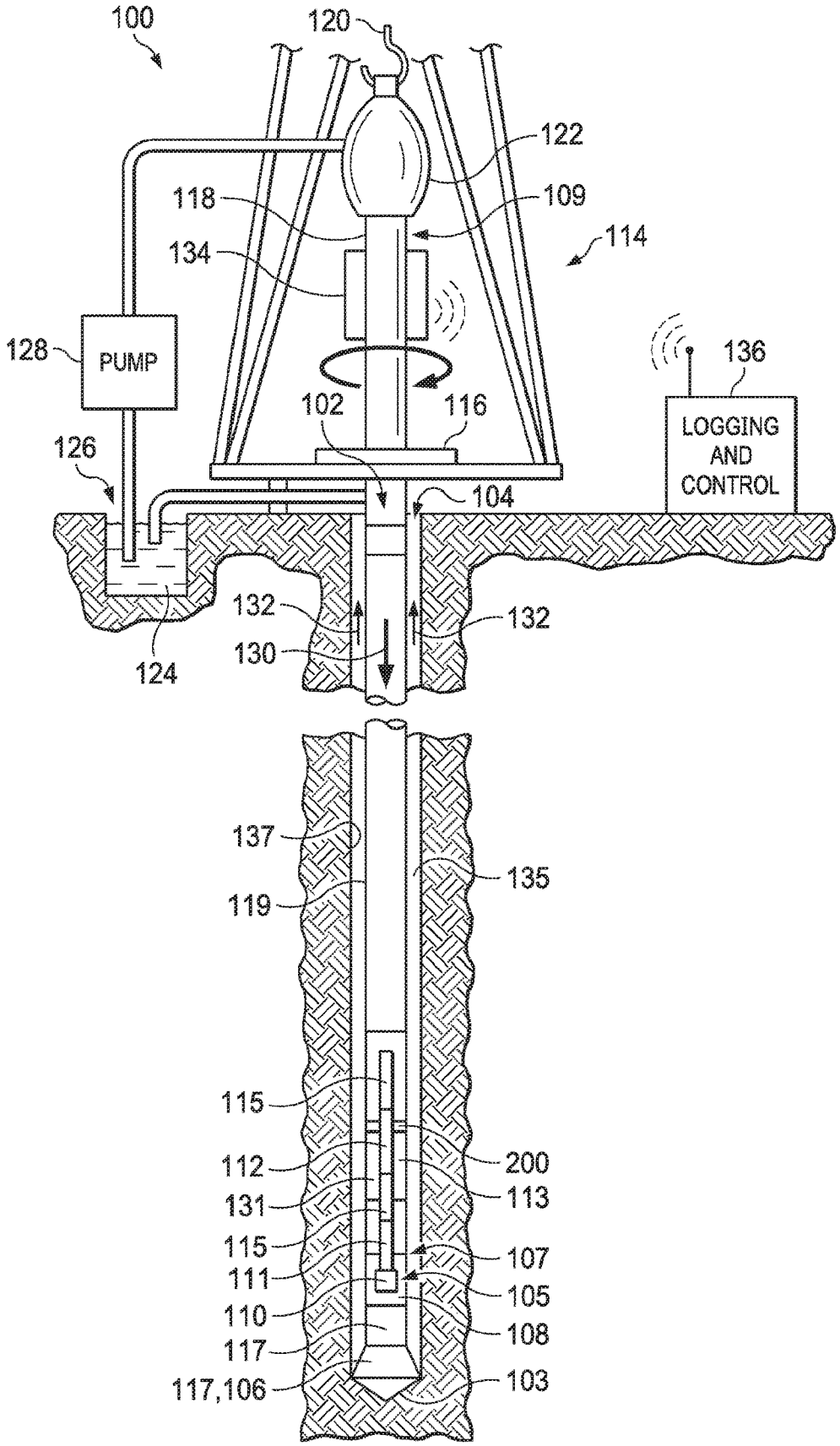
FIG. 1 is a side view of an example embodiment of a hydrocarbon recovery system comprising an example embodiment of a drill string with a centralizer according to a first example embodiment disclosed herein.

Referring now to FIG. 1, an example embodiment of a hydrocarbon recovery system (HRS), generally designated 100, is shown. Although the HRS 100 is shown as being onshore (e.g., on land), in alternative embodiments, the HRS 100 can be installed in an offshore location (e.g., at sea). The HRS 100 generally includes a drill string, generally designated 102, suspended within a borehole, generally designated 104. The borehole 104 extends substantially vertically away from the earth's surface over a vertical wellbore portion or, in some embodiments, deviates at any suitable angle from the earth's surface over a deviated or horizontal wellbore portion. In alternative operating environments, portions or substantially all of a borehole 104 may be vertical, deviated, horizontal, curved, and/or combinations thereof.

The drill string 102 includes a drill bit 106 at a lower end 103 of the drill string 102 and a universal bottom hole orienting (UBHO) sub 108 connected above the drill bit 106. The UBHO sub 108 includes a mule shoe 110 configured to connect with a stinger or pulser helix 111 on a top side, generally designated 105, of the mule shoe 110. The HRS 100 further includes an electronics casing 113 incorporated within the drill string 102 above the UBHO sub 108, for example, connected to a top side, generally designated 107, of the UBHO sub 108. The electronics casing 113 may at least partially house the stinger or pulser helix 111, an isolator 115 connected above the stinger or pulser helix 111, an isolated mass 112 connected above the isolator 115, an isolator 115 connected above the isolated mass 112, and/or centralizers 200. The isolated mass 112 can include electronic components. The HRS 100 includes a platform and derrick assembly, generally designated 114, positioned over the borehole 104 at the surface. The platform and derrick assembly 114 includes a rotary table 116, which engages a kelly 118 at an upper end, generally designated 109, of the drill string 102 to impart rotation to the drill string 102. The drill string 102 is suspended from a hook 120 that is attached to a traveling block. The drill string 102 is positioned through the kelly 118 and the rotary swivel 122 which permits rotation of the drill string 102 relative to the hook 120. Additionally, or alternatively, a top drive system may be used to impart rotation to the drill string 102.

The HRS 100 further includes drilling fluid 124 which may include a water-based mud, an oil-based mud, a gaseous drilling fluid, water, brine, gas, and/or any other suitable fluid for maintaining bore pressure and/or removing cuttings from the area surrounding the drill bit 106. Some volume of drilling fluid 124 may be stored in a pit, generally designated 126, and a pump 128 may deliver the drilling fluid 124 to the interior of the drill string 102 via a port in the rotary swivel 122, causing the drilling fluid 124 to flow downwardly through the drill string 102, as indicated by directional arrow 130. The drilling fluid 124 may pass through an annular space 131 between the electronics casing 113 and each of the pulser helix 111, the centralizer 200, and/or the isolated mass 112 prior to exiting the UBHO sub 108. After exiting the UBHO sub 108, the drilling fluid 124 may exit the drill string 102 via ports in the drill bit 106 and be circulated upwardly through an annulus region 135 between the outside of the drill string 102 and a wall 137 of the borehole 104, as indicated by directional arrows 132. The drilling fluid 124 may lubricate the drill bit 106, carry cuttings from within the borehole 104 up to the surface as the drilling fluid 124 is returned to the pit 126 for recirculation and/or reuse, and/or create a mudcake layer (e.g., filter cake) on the walls 137 of the borehole 104.

The drill bit 106 may generate vibratory forces and/or shock forces in response to encountering hard formations during the drilling operation. Although the drill bit 106 itself can be considered an excitation source 117 that provides some vibratory excitation to the drill string 102, the HRS 100 may further include an excitation source 117 such as an axial excitation tool 119 and/or any other vibratory device configured to agitate, vibrate, shake, and/or otherwise change a position of an end of the drill string 102 and/or any other component of the drill string 102 relative to the wall 137 of the borehole 104. In some cases, operation of such an axial excitation tool 119 may generate oscillatory movement of selected portions of the drill string 102, so that the drill string 102 is less likely to become hung or otherwise prevented from advancing into and/or out of the borehole 104. In some embodiments, low frequency oscillations of one or more excitation sources 117 may have values of about 5 Hz to about 100 Hz, inclusive. The term excitation source 117 is intended to refer to any source of the vibratory or shock forces described herein, including, but not limited to, a drill bit 106, an axial excitation tool 119 that is purpose built to generate such forces, and/or combinations thereof. It will further be appreciated that drill bit whirl and stick slip are also primary sources of lateral shock and vibration and, hence, can also be primary sources of such lateral shock and vibration inputs.

In the embodiment of FIG. 1, the HRS 100 further includes a communications relay 134 and a logging and control processor 136. The communications relay 134 may receive information and/or data from sensors, transmitters, receivers, and/or other communicating devices that may form a portion of the isolated mass 112. In some embodiments, the information is received by the communications relay 134 via a wired communication path through the drill string 102. In other embodiments, the information is received by the communications relay 134 via a wireless communication path. In some embodiments, the communications relay 134 transmits the received information and/or data to the logging and control processor 136. Additionally, or alternatively, the communications relay 134 can receive data and/or information from the logging and control processor 136. In some embodiments, upon receiving the data and/or information, the communications relay 134 forwards the data and/or information to the appropriate sensor(s), transmitter(s), receiver(s), and/or other communicating devices. The isolated mass 112 may include measuring while drilling (MWD) devices and/or logging while drilling (LWD) devices and the isolated mass 112 may include multiple tools or subs and/or a single tool and/or sub. In the embodiment of FIG. 1, the drill string 102 includes a plurality of tubing sections; that is, the drill string 102 is a jointed or segmented string. Alternative embodiments of drill string 102 can include any other suitable conveyance type, for example, coiled tubing, wireline, and/or wired drill pipe. The HRSs 100 that implement at least one embodiment of a centralizer 200 may be referred to as downhole systems for isolating a component, (e.g., for isolating lateral and/or axial forces to an isolated mass 112). The centralizer 200 can comprise one or more of the centralizers 400, 500, 600, 700, and/or 800 disclosed herein.

Figure 2:
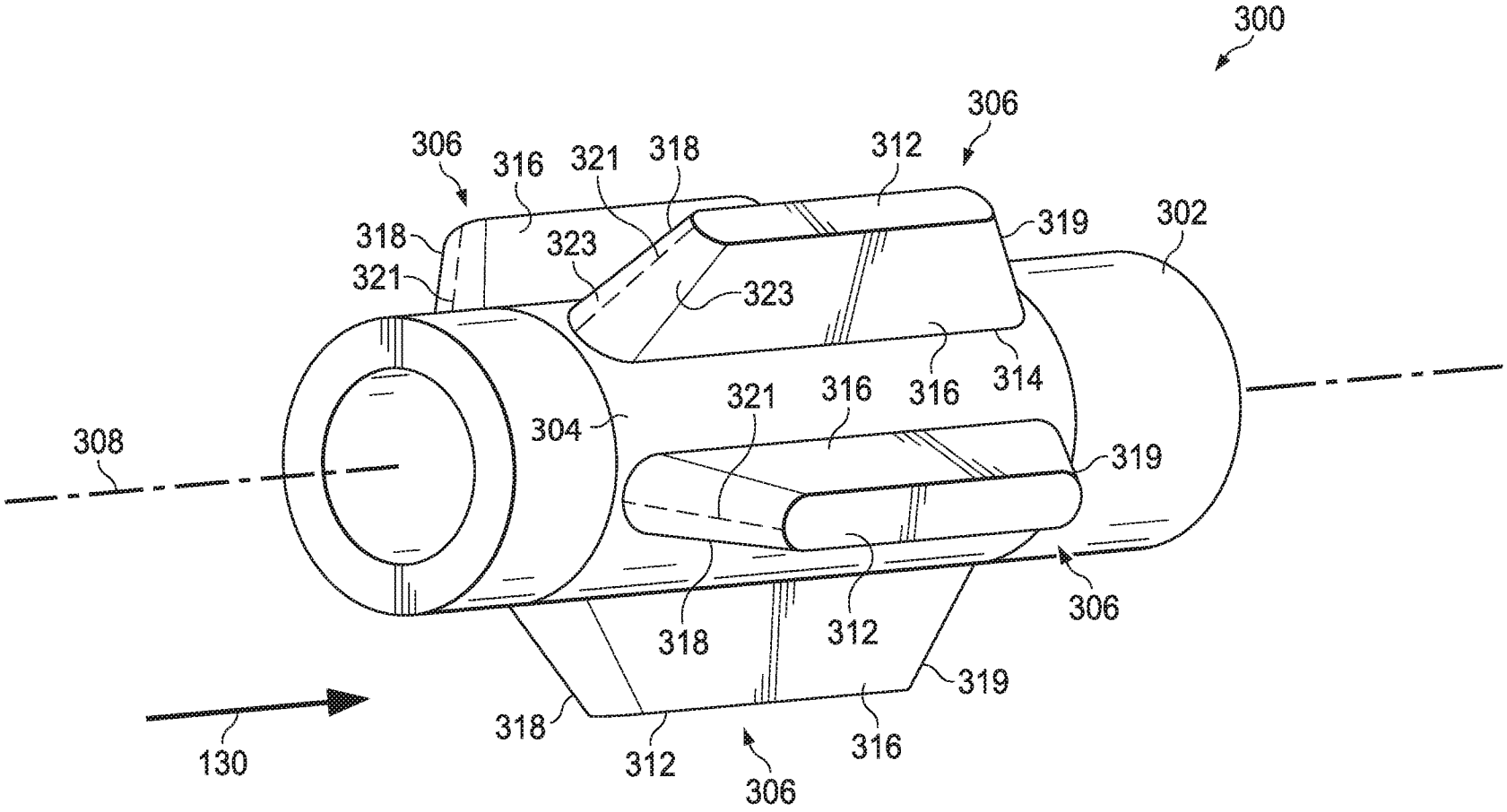
FIG. 2 (PRIOR ART)
FIG. 2 is an oblique view of a prior art centralizer.
Figure 3:
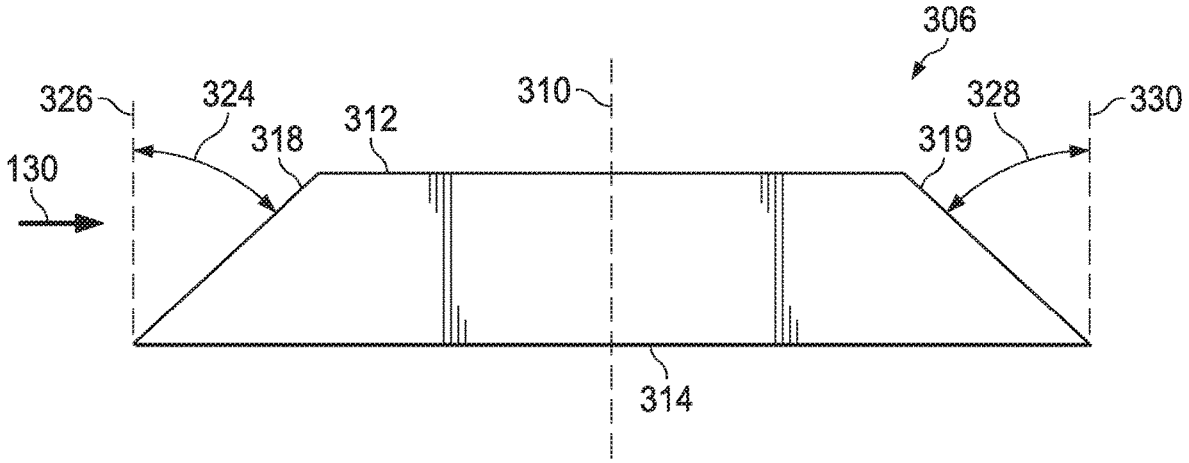
FIG. 3 (PRIOR ART)
FIG. 3 is a side view of a fin of the prior art centralizer of FIG. 2.
Figure 4:
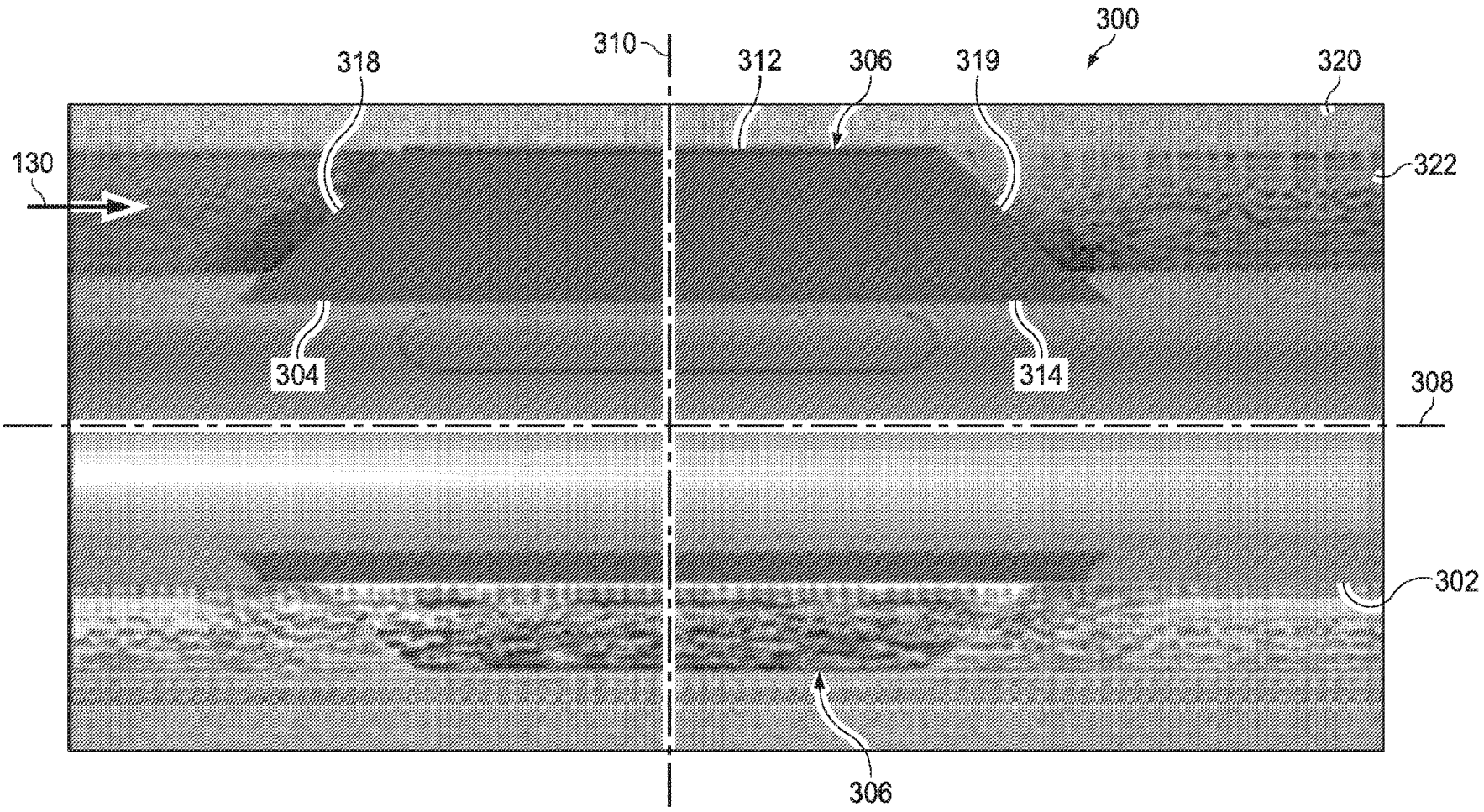
FIG. 4 (PRIOR ART)
FIG. 4 is a cross-sectional side view of a graphical representation of a computational fluid dynamics analysis of the prior art centralizer of FIG. 2.

Referring now to FIGS. 2 to 4, a prior art centralizer 300 is shown. The prior art centralizer, generally designated 300, comprises a tubular carrier 302 comprising a reduced outside diameter section 304. The prior art centralizer 300 further comprises conventional fins, generally designated 306, attached to the carrier 302 about the reduced outside diameter section 304. In this embodiment, the centralizer 300 includes five conventional fins 306 disposed about the central axis 308 in an evenly distributed angular array. The conventional fins 306 are substantially longitudinally symmetrical about a cutting plane 310, as shown in FIG. 3). Accordingly, the conventional fins 306 perform substantially the same regardless of which longitudinal ends of the conventional fins 306 are disposed upstream, relative to the anticipated fluid flow direction.

Referring now to FIGS. 2 and 3, primarily, each conventional fin 306 can be described generally as comprising a wall interface 312 disposed and/or extending the furthest radially outward away from the carrier 302, a carrier interface 314 disposed most radially inward toward and/or in contact with the carrier 302, opposing side surfaces 316 that join the wall interface 312 to the carrier interface 314, and opposing longitudinal ends 318, 319 that not only join the wall interface 312 to the carrier interface 314 but additionally join the opposing side surfaces 316 together to define a substantially enclosed and/or solid volumetric shape. In this embodiment, each of the wall interface 312 and the carrier interface 314 comprise stadium shapes, with the carrier interface 314 being a larger stadium shape than the stadium shape of the wall interface 312. The side surfaces 316 join the straight sides of the wall interface 312 to the straight sides of the carrier interface 314, while an upstream longitudinal end 318 and a downstream longitudinal end 319 join the curved portions of the wall interface 312 to the curved portions of the carrier interface 314.

Accordingly, the longitudinal ends 318, 319 are sloped toward the cutting plane 310 and are curved so that a rounded and sloped profile is provided. The rounded and sloped upstream longitudinal end 318 is the portion of the conventional fins 306 that is first contacted by fluids and the particulate matter carried by fluids passing by the prior art centralizer 300. The upstream longitudinal end 318 can be described as comprising an angular bisection line 321 disposed angularly centered along the length of the upstream longitudinal end 318. Since the upstream longitudinal end 318 comprises no flat surface, an edge profile 323 (half of the upstream longitudinal end 318) can be described as providing a very large smooth and curved transition between the angular bisection line 321 and the flat adjacent side surfaces 316. Accordingly, when fluid and particulate matter flow along the upstream longitudinal end 318 and eventually along the side surfaces 316, the smooth and gradual nature of the edge profile 323 tends to maintain substantially ordered fluid flow throughout travel against the edge profile 323 and the subsequently along the side surfaces 316, without significant turbulence immediately downstream of the edge profile 323 and without significant boundary layer separation from side surfaces 316.

The prior art centralizer 300 can be described as comprising an upstream angle 324, which is measured between the sloped upstream longitudinal end 318 and a radial line 326 extending from the upstream end of the upstream longitudinal end 318. Similarly, the prior art centralizer 300 can be described as comprising a downstream angle 328 of approximately 45 degrees as measured between the sloped downstream longitudinal end 319 and a radial line 330 extending from the downstream end of the downstream longitudinal end 319. Each of the upstream angle 324 and the upstream angles of substantially similar prior art systems have been observed as comprising angles of about 30 degrees to about 45 degrees, with the upstream angle being associated with at least one of a rounded leading-edge and an angled leading edge.

Referring now to FIG. 4, a cross-sectional side view of a graphical representation of a computational fluid dynamics analysis of the prior art centralizer 300 is shown with the cross-section being taken through an angular center of the conventional fin 306 shown at the top of the view. The prior art centralizer 300 is shown disposed in a fluid conduit 320 comprising an inner surface 322. While only visible with regard to the top conventional fin 306 in the view, the conventional fins 306 are generally disposed within the fluid conduit 320 in a manner that, at least initially, centralizes the prior art centralizer 300, and components connected immediately upstream and downstream to the prior art centralizer 300, within the fluid conduit 320. Also, the prior art centralizer 300, at least initially, provides lateral and/or cocking compliance for the prior art centralizer 300 and connected components.

The prior art centralizer 300 includes curved leading edges with gradual lead-ins, as described above. These characteristics, which follow conventional aerodynamic (hydrodynamic) principles, reduce the drag on the conventional fins 306 and reduce the pressure drop across the prior art centralizer 300. The contoured shape of the conventional fins 306 and above-described large upstream angle 324 and the large downstream angle 328 promote organized streamlines with predictable laminar flow as shown in FIG. 4.

Figure 5:
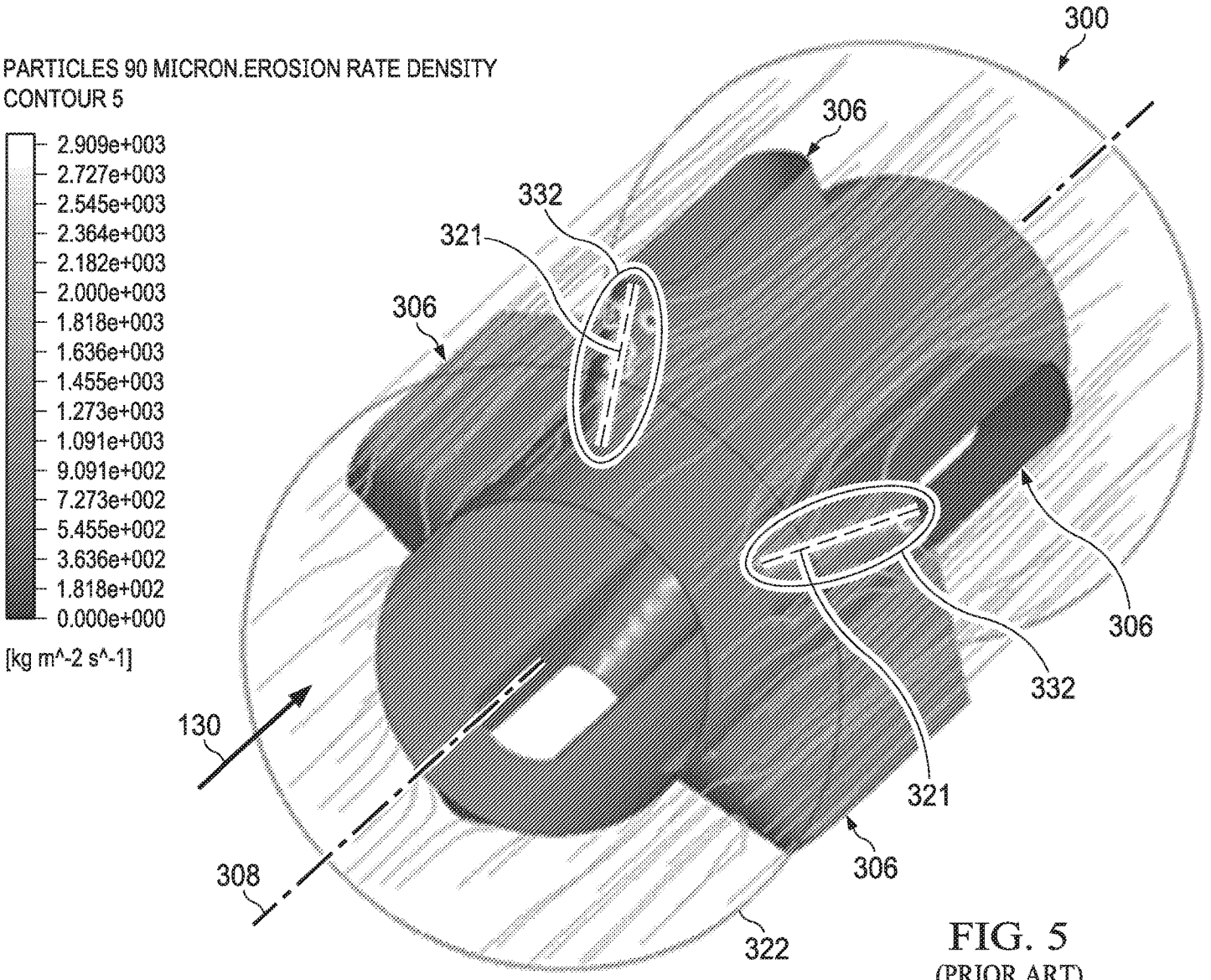
FIG. 5 (PRIOR ART)
FIG. 5 is an oblique view of a graphical representation of a computational fluid dynamics analysis of the prior art centralizer of FIG. 2.
Figure 6:
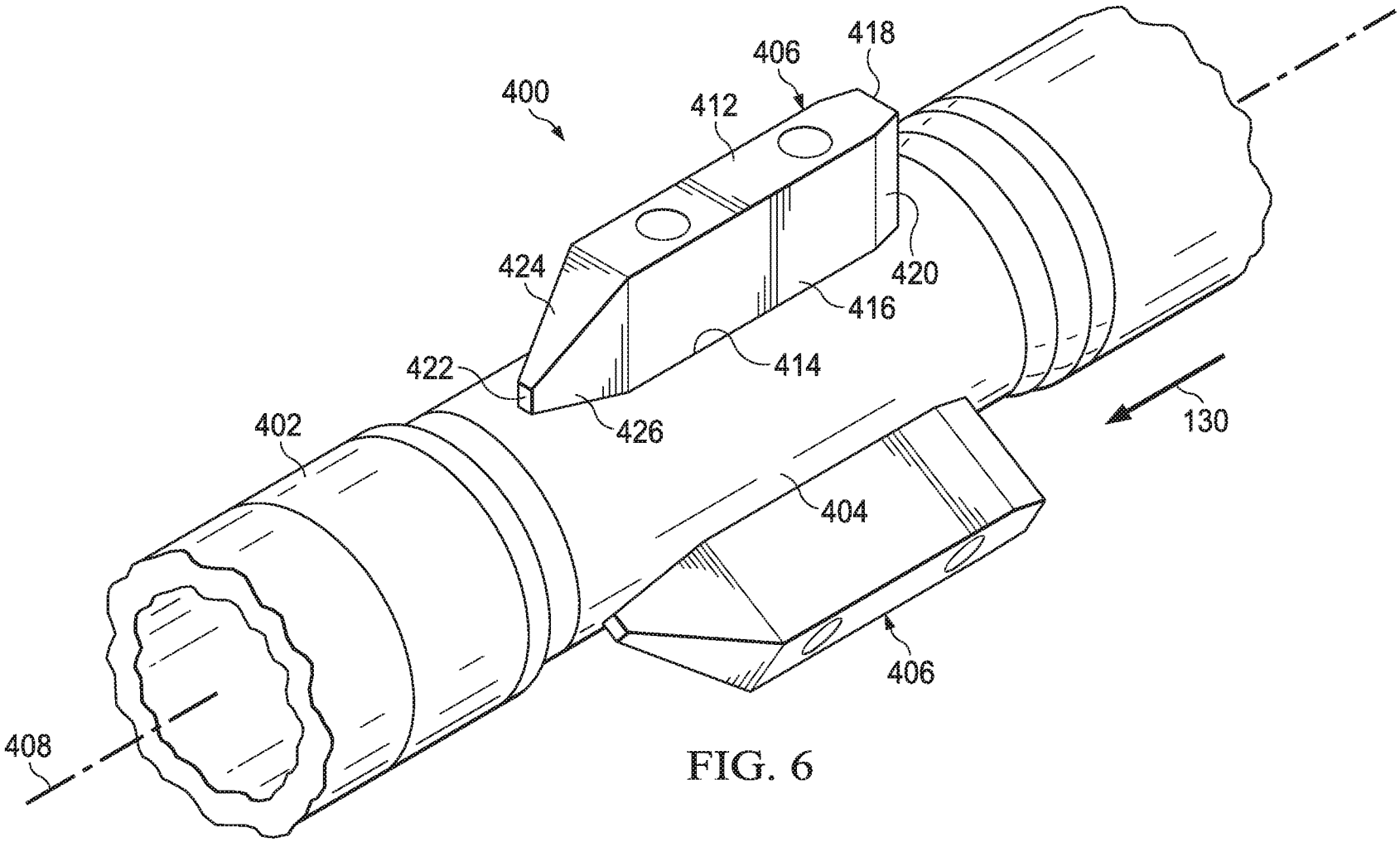
FIG. 6 is an oblique of the centralizer shown in the hydrocarbon recovery system of FIG. 1.
Figure 7:
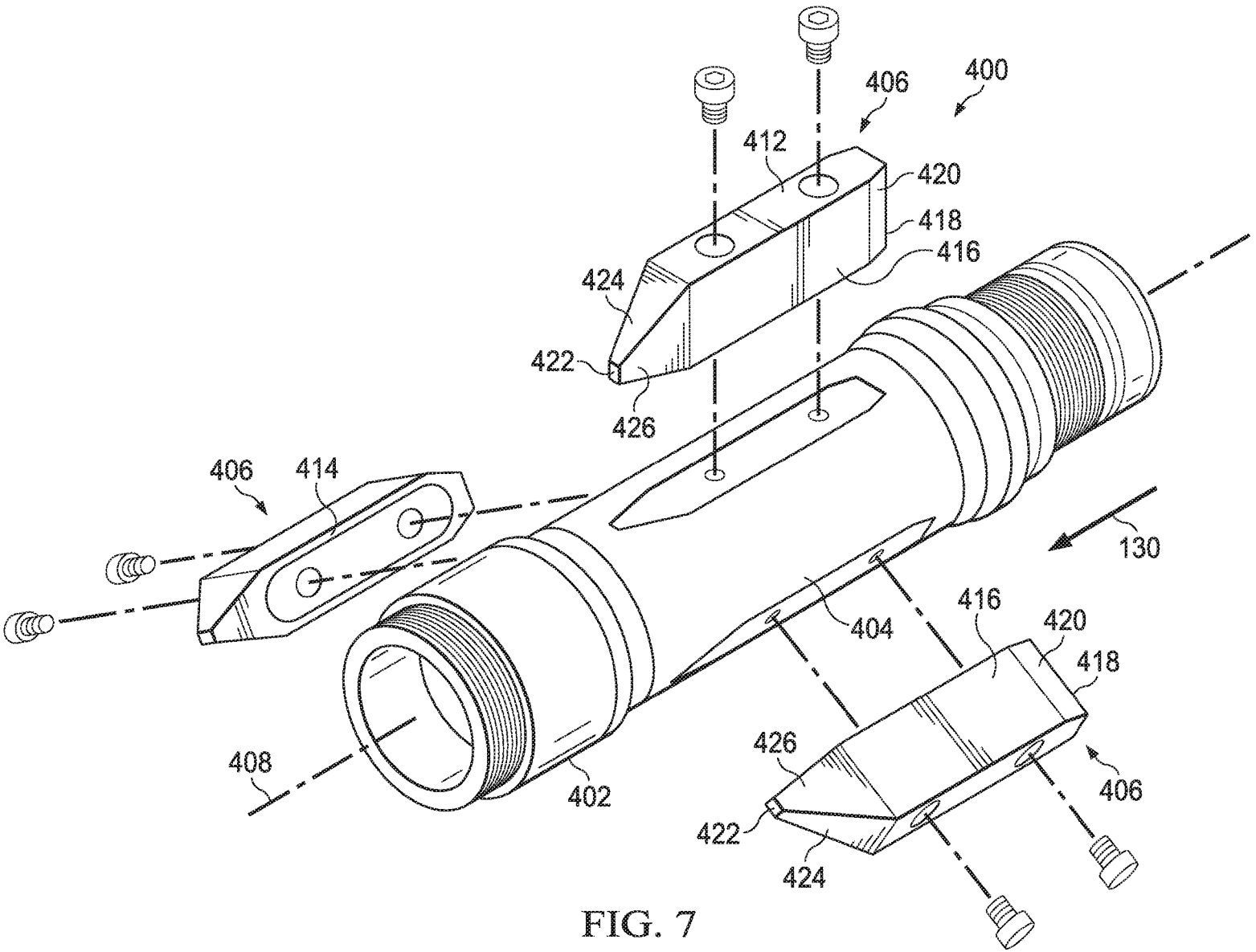
FIG. 7 is an oblique exploded view of the centralizer of FIG. 6.
Figure 8:
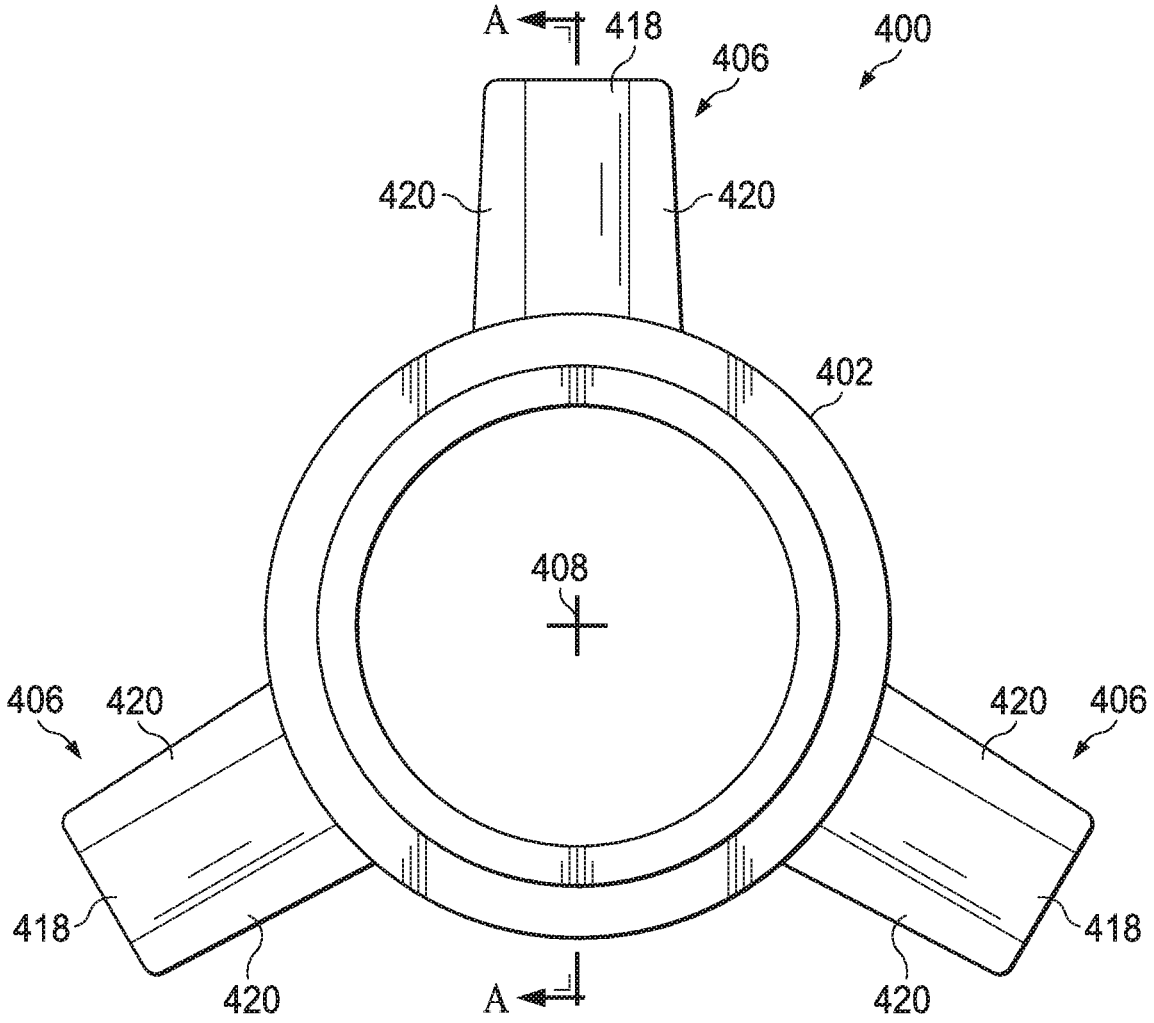
FIG. 8 is a top view of the centralizer of FIG. 6.
Figure 9:
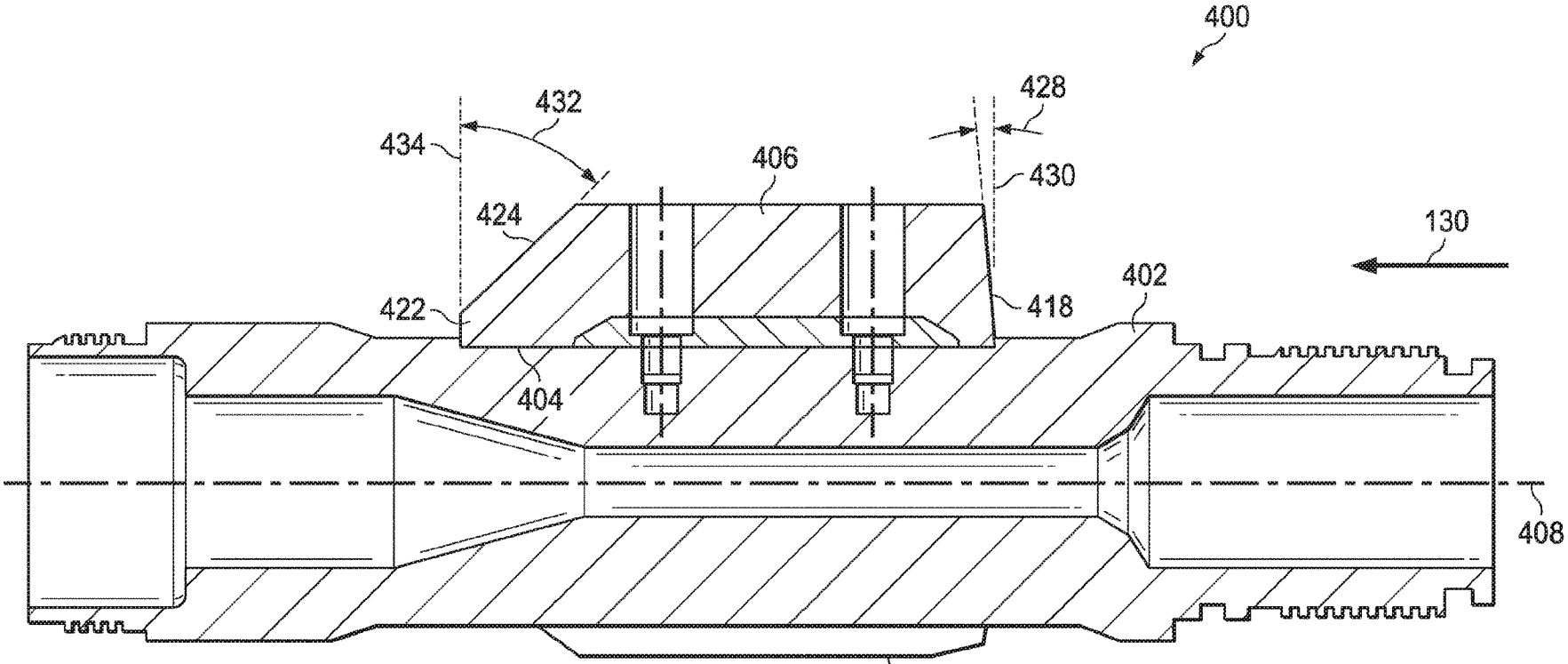
FIG. 9 is a cross-sectional side view of the centralizer of FIG. 6, taken along cutting line A-A of FIG. 8.

Referring now to FIG. 5, the prior art centralizer 300 is shown along with a graphical representation of computational fluid dynamics analysis, showing predicted erosion of the prior art centralizer 300, the graphical representation of FIG. 5 having been generated using the same computational fluid dynamics model of Prior Art FIG. 4. In short, although the prior art centralizer 300 design does limit the pressure drop across the prior art centralizer 300, it causes scouring impacts of the embedded particles in the erosive flow at, for example, zones 332. While this type of impact may be suitable for hard materials such as metals, the impact can be highly damaging to elastomers. Direct impacts on elastomers can be absorbed by the compliant aspects of such elastomers, yet scouring impacts as are shown and described herein can cause an abrasive tearing mode of the elastomeric material, which results in localized loss of material. In fact, field results observed in used parts corroborate the described erosive effects.

Referring now to FIGS. 6 to 9, a first example embodiment of a centralizer, generally designated 400, is shown. The centralizer 400 comprises a tubular carrier 402 comprising a reduced outside diameter section 404. The centralizer 400 further comprises fins, generally designated 406, attached to the carrier 402 circumferentially about the reduced outside diameter section 404. In this embodiment, the centralizer 400 includes three fins 406 circumferentially disposed about the central axis 408 in an evenly distributed angular array (e.g., so as to have a uniform fin pitch). The fins 406 are configured for a directional installation relative to anticipated fluid flow direction, indicated by arrow 130. In other words, the fins 406 are not symmetric longitudinally and it is advantageous to arrange the centralizer 400 so that particular longitudinal ends of the fins 406 first encounter oncoming fluid flow.

Each fin 406 can be described generally as comprising a wall interface 412 disposed and/or extending the furthest radially outward away from the carrier 402, a carrier interface 414 disposed most radially inward toward and/or in contact with the carrier 402, and opposing side surfaces 416 that join the wall interface 412 to the carrier interface 414. The fins 406 further comprise an upstream impact surface 418 that joins the wall interface 412 and the carrier interface 414 together and two side wedge surfaces 420 that are connected between each of the impact surface 418, the wall interface 412, and the carrier interface 414, together defining a substantially enclosed and/or solid volumetric shape. The fins 406 also comprise a substantially rectangular truncated tip surface 422 oriented in a most downstream (e.g., based on the anticipated fluid flow direction 130) portion of the fins 406. A radially outermost side of the truncated tip surface 422 is connected to the wall interface 412 by a radially outwardly extending downstream tail surface 424. Angularly opposing sides of the truncated tip surface 422 are connected to the wall interface 412 and the associated side surfaces 416 by tail sidewalls 426.

The fin 406 can be described as comprising an upstream angle 428, which is measured between the impact surface 418 and a radial line 430 extending perpendicular from where the impact surface 418 intersects the reduced outside diameter section 404. Similarly, the fin 406 can be described as comprising a downstream angle 432 of approximately 45 degrees as measured between the radially outward downstream tail surface 424 and a radial line 434 extending perpendicular, relative to the central axis 408, from the downstream end of the radially outward downstream tail surface 424. In some embodiments, the upstream angle 428 can be 0 degrees or very close to 0 degrees. In some embodiments, the upstream angle 428 can be within a range of about 0 degrees to about 10 degrees, inclusive; within a range of about 1 degree to about 9 degrees, inclusive; within a range of about 2 degrees to about 7 degrees, inclusive; or within a range of about 3 degrees to about 5 degrees, inclusive. In some cases, an upstream angle 428 may be preferred to be about 1 degree to about 3 degrees, inclusive. In the example embodiment shown, the impact surface 418 is substantially planar (e.g., having only curvatures associated with tolerance values inherent from the technique(s) used to form the fins 406).

Because the impact surface 418 is nearly orthogonal relative to the primary direction of fluid flow that is indicated by directional arrow 130, the impact surface 418 presents a substantial impediment to particulate matter carried within the fluid flow. Instead of being gently guided around the fin 406 as fluid is guided around conventional fins 306 by the curved upstream longitudinal ends 318 thereof, in the example embodiment described herein, the particulate matter carried by the fluid is purposefully impacted against the impact surface 418. In cases where the fins 406 are constructed of elastomer(s), a great amount of kinetic energy of the particles that impact the impact surface 418 is transferred to the elastomeric fins 406 and dissipated by the fins 406 due to the compliant aspects inherent in the use of such elastomeric materials. After such impacts, the reduced energy particulate matter remains entrained in the fluid flow; however, because the particulate matter is moving significantly slower as compared to the velocity prior to impacting the impact surface 418, the particulate matter causes less scouring and/or erosion to the surfaces of the fins 406 as the particulate matter is moved past the fins 406 in a downstream direction. In this embodiment, the larger downstream angle 432 aides in reorganizing fluid flow into relatively more smooth streamlines and/or laminar flow (e.g., to reduce turbulence) so that, although some of the fluid is disrupted by the blunt upstream impact with the impact surface 418, an overall pressure drop across the centralizer 400 is reduced as compared to a case where the downstream angle 432 is smaller (e.g., more upright, as is the case for the impact surface 418).

Figure 10:
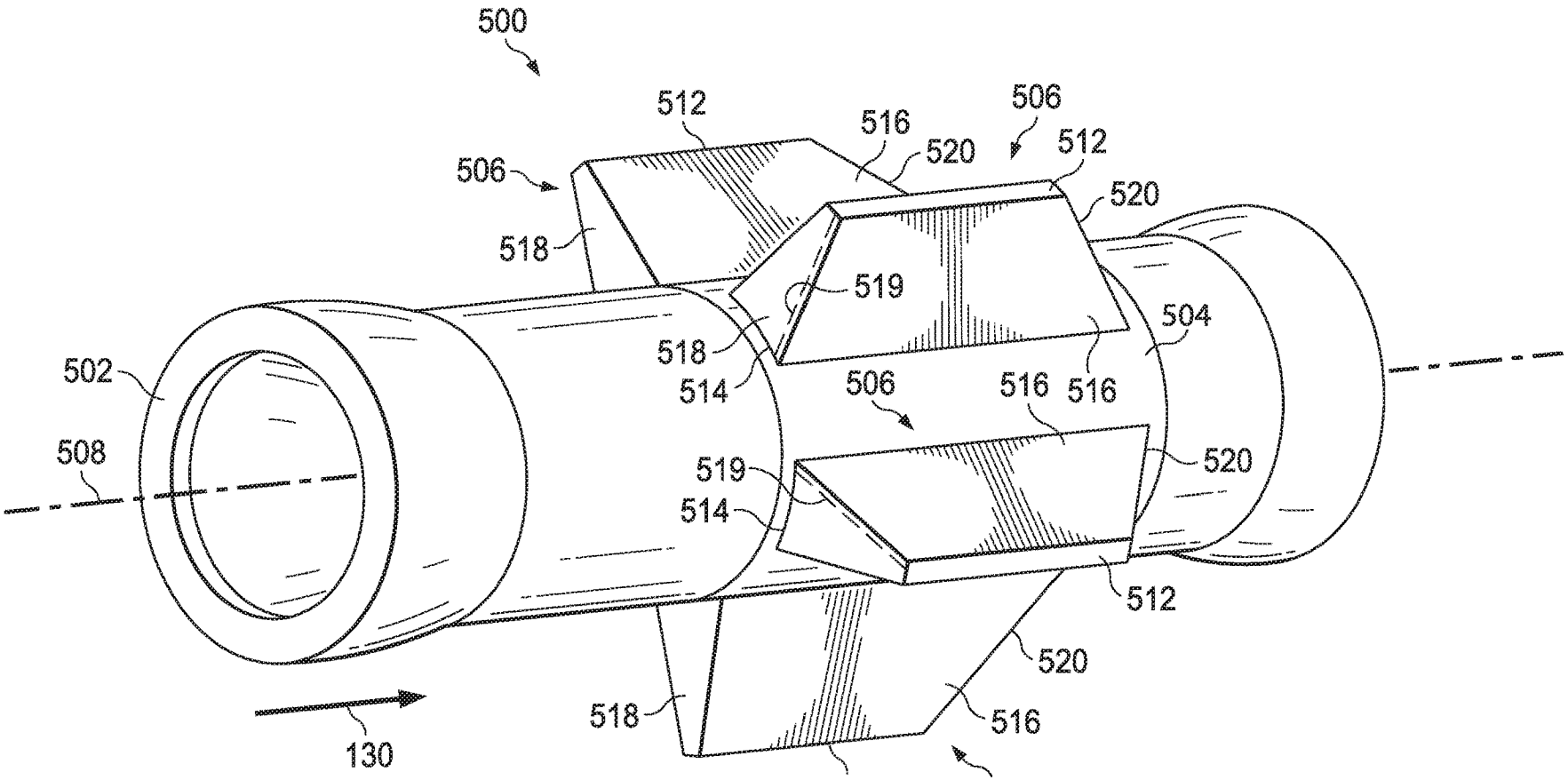
FIG. 10 is an oblique view of a second example embodiment of a centralizer.
Figure 11:
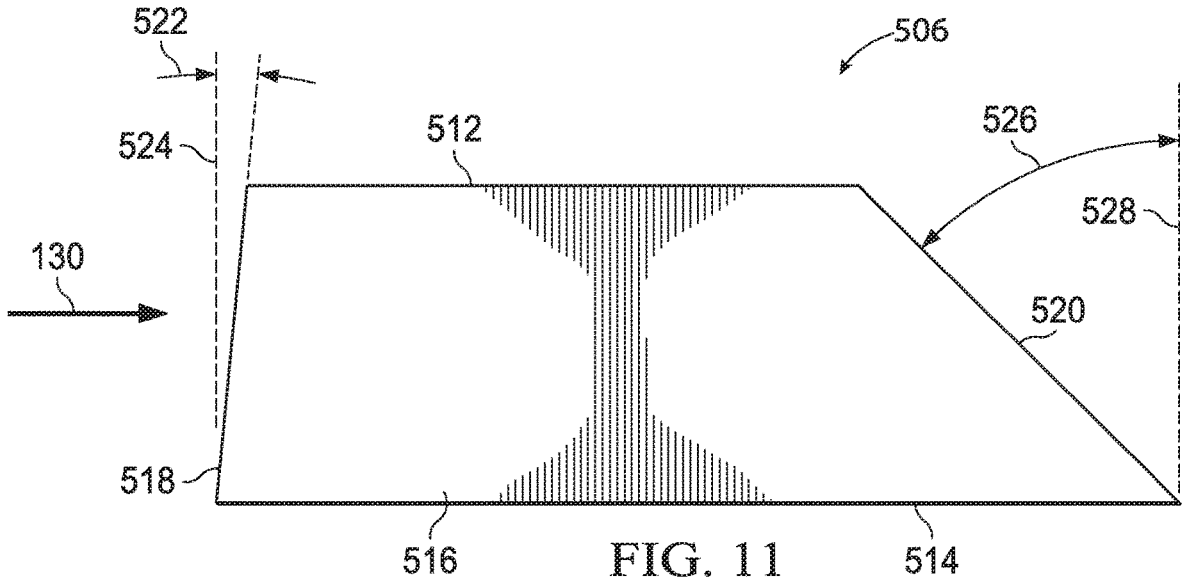
FIG. 11 is a side view of a fin of the centralizer of FIG. 10.
Figure 12:
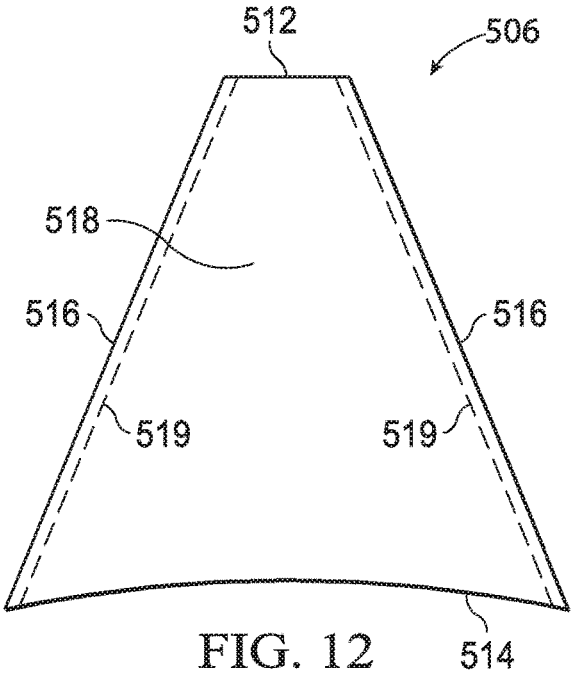
FIG. 12 is a bottom view of a fin of the centralizer of FIG. 10.

Referring now to FIGS. 10 to 12, a second example embodiment of a centralizer, generally designated 500, is shown. The centralizer 500 comprises a tubular carrier 502 comprising a reduced outside diameter section 504. The centralizer 500 further comprises fins, generally designated 506, attached to the carrier 502 circumferentially about the reduced outside diameter section 504. In this embodiment, the centralizer 500 includes five fins 506 disposed circumferentially about the central axis 508 in an evenly distributed angular array (e.g., so as to have a uniform fin pitch). The fins 506 are configured for a directional installation relative to anticipated fluid flow direction, indicated by arrow 130. In other words, the fins 506 are not symmetric longitudinally and it is advantageous to arrange the centralizer 500 so that particular longitudinal ends of the fins 506 first encounter oncoming fluid flow.

Each fin 506 can be described generally as comprising a wall interface 512 disposed and/or extending the furthest radially outward away from the carrier 502, a carrier interface 514 disposed most radially inward toward and/or in contact with the carrier 502, and opposing side surfaces 516 that join the wall interface 512 to the carrier interface 514. The fins 506 further comprise an upstream impact surface 518 that joins the wall interface 512 to the carrier interface 514 and the two side surfaces 516. The fins 506 also comprise a downstream tail surface 520 that joins the wall interface 512 to the carrier interface 514 and the two side surfaces 516. Together, the wall interface 512, the carrier interface 514, the side surfaces 516, the upstream impact surface 518, and the downstream tail surface 520 define a substantially enclosed and/or solid volumetric shape.

The fins 506 can be described as comprising an upstream angle 522 which is measured between the impact surface 518 and a radial line 524 extending perpendicular from where the upstream end of the impact surface 518 intersects the reduced outside diameter section 504. Similarly, the fin 506 can be described as comprising a downstream angle 526 of approximately 45 degrees as measured between the downstream tail surface 520 and a radial line 528 extending perpendicular, relative to the central axis 508, from the downstream end of the downstream tail surface 520. In some embodiments, the upstream angle 522 can be 0 degrees or very close to 0 degrees. In some embodiments, the upstream angle 522 can be within a range of about 0 degrees to about 10 degrees, inclusive; within a range of about 1 degree to about 9 degrees, inclusive; within a range of about 2 degrees to about 7 degrees, inclusive; or within a range of about 3 degrees to about 5 degrees, inclusive. In some cases, an upstream angle 522 may be preferred to be about 1 degree to about 3 degrees, inclusive. In the example embodiment shown, the impact surface 518 is substantially planar (e.g., having only curvatures associated with tolerance values inherent from the technique(s) used to form the fins 506) and the angular limits of the planar portion of the impact surface 518 are defined by boundary lines 519.

Because the impact surface 518 is nearly orthogonal relative to the primary direction of fluid flow that is indicated by directional arrow 130, the impact surface 518 presents a substantial impediment to particulate matter carried within the fluid flow. Instead of being gently guided around the fin 506 as fluid is guided around conventional fins 306 by the curved upstream longitudinal ends 318 thereof, in the example embodiment described herein, the particulate matter carried by the fluid is purposefully impacted against the impact surface 518. In cases where the fins 506 are constructed of elastomer(s), a great amount of kinetic energy of the particles that impact the impact surface 518 is transferred to the elastomeric fins 506 and dissipated by the fins 506 due to the compliant aspects inherent in the use of such elastomeric materials. After such impacts, particulate matter can move past the boundary lines 519, experiencing a fast change in direction from primarily radial to primarily longitudinal flow along the flat side surfaces 516. Since the fluid and particulate matter change direction abruptly, the flow is generally turbulent, so that high speed fluid flow remains largely separated from at least the upstream portion of the flat side surfaces 516. Also, since any particulate that is entrained in the fluid flow and contacts the side surfaces 516 is moving slower and/or with less energy, the particulate matter causes less scouring and/or erosion to the surfaces of the fin 506 as the particulate matter is moved past the fins 506 in a downstream direction. The reduced energy particulate matter remains entrained in the fluid flow but, because the particulate matter is moving significantly slower as compared the velocity to prior to impacting the impact surface 518, the particulate matter causes less scouring and/or erosion to the surfaces of the fins 506 as the particulate matter is moved past the fins 506 in a downstream direction. In this embodiment, the larger downstream angle 526 aides in reorganizing fluid flow into relatively more smooth streamlines and/or laminar flow (e.g., to reduce turbulence) so that, although some of the fluid is disrupted by the blunt upstream impact with the impact surface 518, an overall pressure drop across the centralizer 500 is reduced as compared to a case where the downstream angle 526 is smaller (e.g., more upright, as is the case for the impact surface 518).

Figure 13:
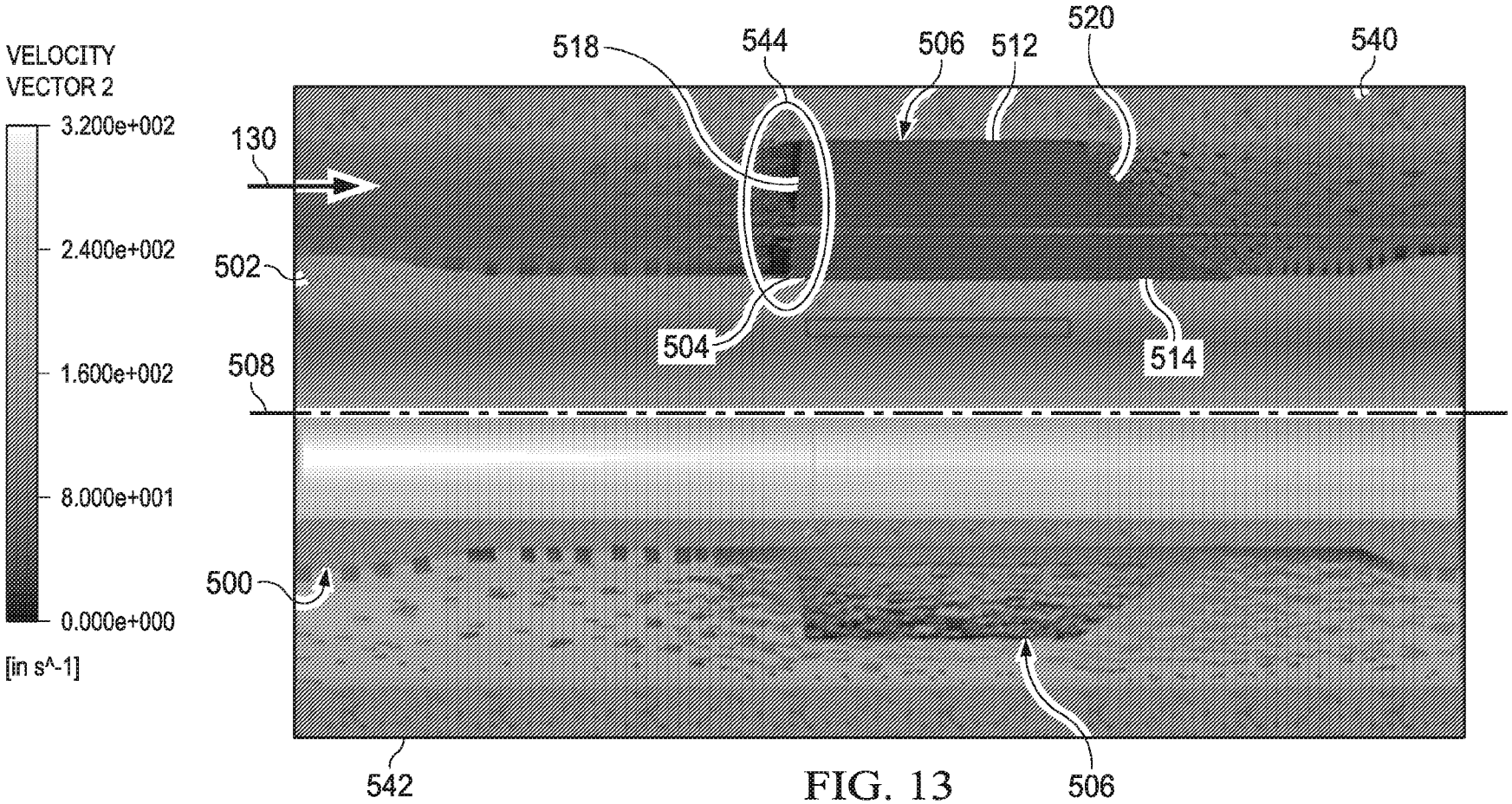
FIG. 13 is a cross-sectional side view of a graphical representation of a computational fluid dynamics analysis of the centralizer of FIG. 10.

Referring now to FIG. 13, a cross-sectional side view of a graphical representation of a computational fluid dynamics analysis of the centralizer 500 is shown, with the cross-section being taken through an angular center of the fin 506 shown at the top of the view. The centralizer 500 is shown disposed in a fluid conduit 540 comprising an inner surface 542. While only visible with regard to the top fin 506 in the view, the fins 506 are generally disposed within the fluid conduit 540 in a manner that, at least initially, centers the centralizer 500, as well as components (e.g., of drill string 102, see FIG. 1) connected immediately upstream and downstream of the centralizer 500, within the fluid conduit 540. Also, the centralizer 500, at least initially, provides lateral and/or cocking compliance for the centralizer 500 and any components connected thereto.

As shown in zone 544, the velocity of the fluid is greatly reduced as a result of impacting the impact surface 518. As mentioned elsewhere herein, by reducing the velocity of the fluid and, accordingly, the particulate matter carried by the fluid, the particulate matter has less kinetic energy to scour, or otherwise erode, the outer surfaces of the fins 506 downstream of the impact surface 518. The relatively larger downstream angle 526 promotes an organized (e.g., less turbulent) increase in fluid velocity as the fluid moves past the fins 506.

Figure 14:
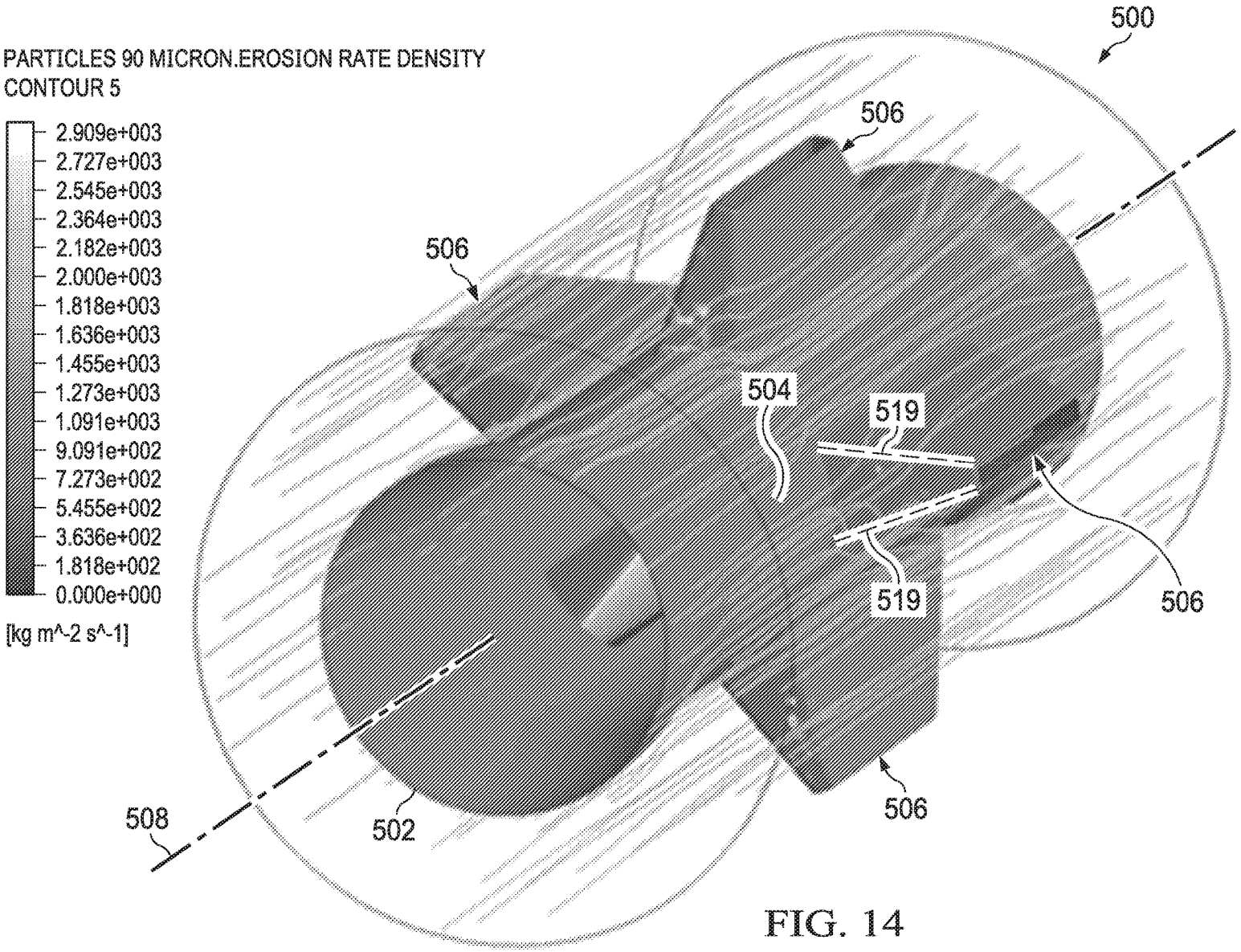
FIG. 14 is an oblique view of a graphical representation of a computational fluid dynamics analysis of the centralizer of FIG. 10.

Referring now to FIG. 14, the centralizer 500 is shown along with a graphical representation of computational fluid dynamics analysis, showing predicted erosion of the centralizer 500, the graphical representation of FIG. 14 having been generated using the same computational fluid dynamics model of FIG. 13. In short, although the centralizer 500 does experience some erosion, the erosion rate density of the impact surface 518 is greatly reduced as compared to the erosion rate density of the conventional fins 306 as shown in the prior art centralizer 300 of FIG. 5. Accordingly, the centralizer 500 is comparatively better suited for withstanding erosive fluid flows as compared to the prior art centralizer 300.

Figure 15:
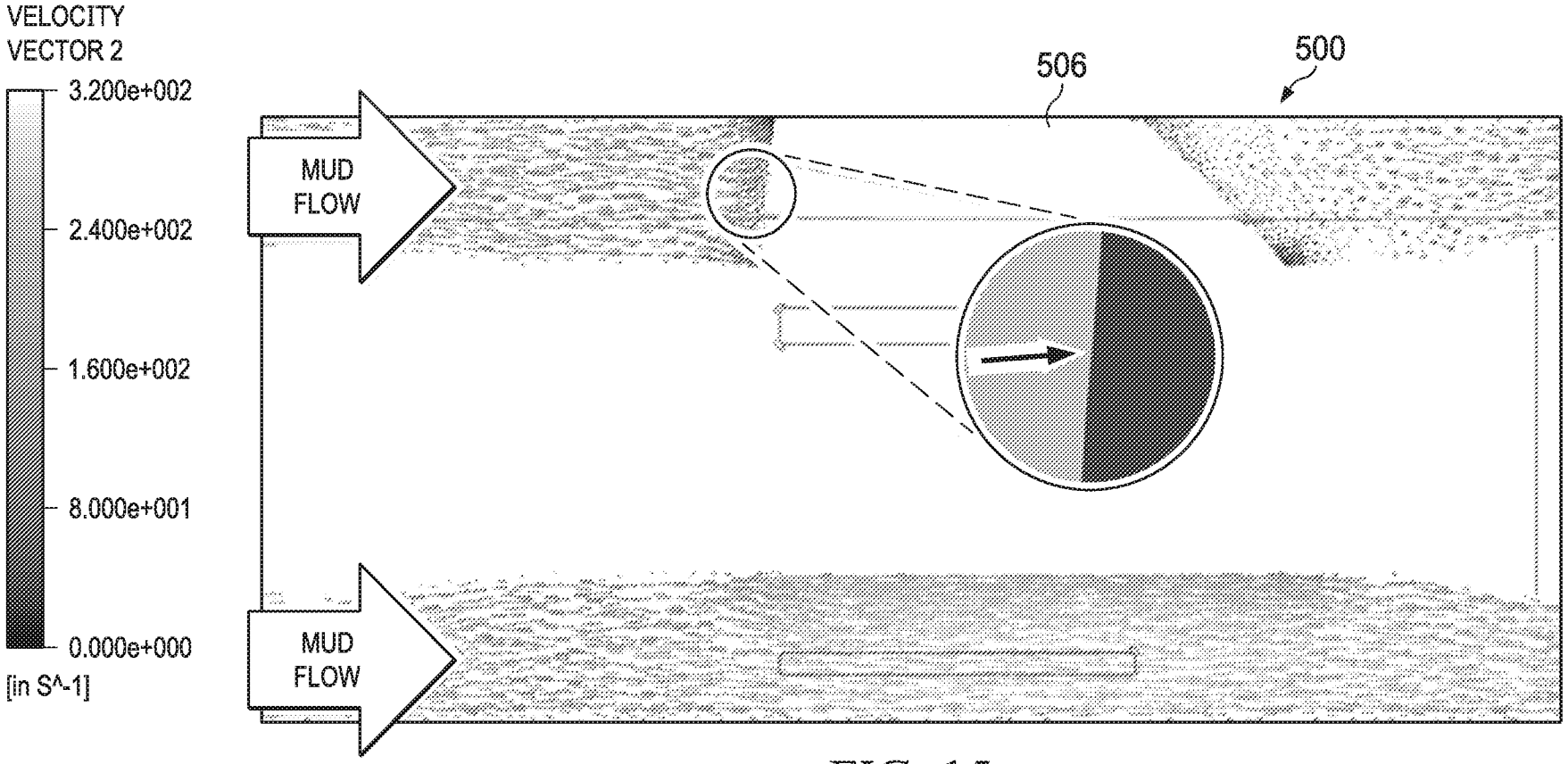
FIG. 15 is a cross-sectional side view of a graphical representation of a computational fluid dynamics analysis of the centralizer of FIG. 10.

Referring now to FIG. 15, the centralizer 500 is shown along with a graphical representation of a computational fluid dynamics analysis of the centralizer 500, the predicted velocity being generated using the same computational fluid dynamics model of FIG. 13. However, FIG. 15 demonstrates with a zoomed view of the fin 506 and shows that the zoomed view of the fin 506 is not experiencing a scouring flow of particulate matter against the fin 506.

Figure 16:
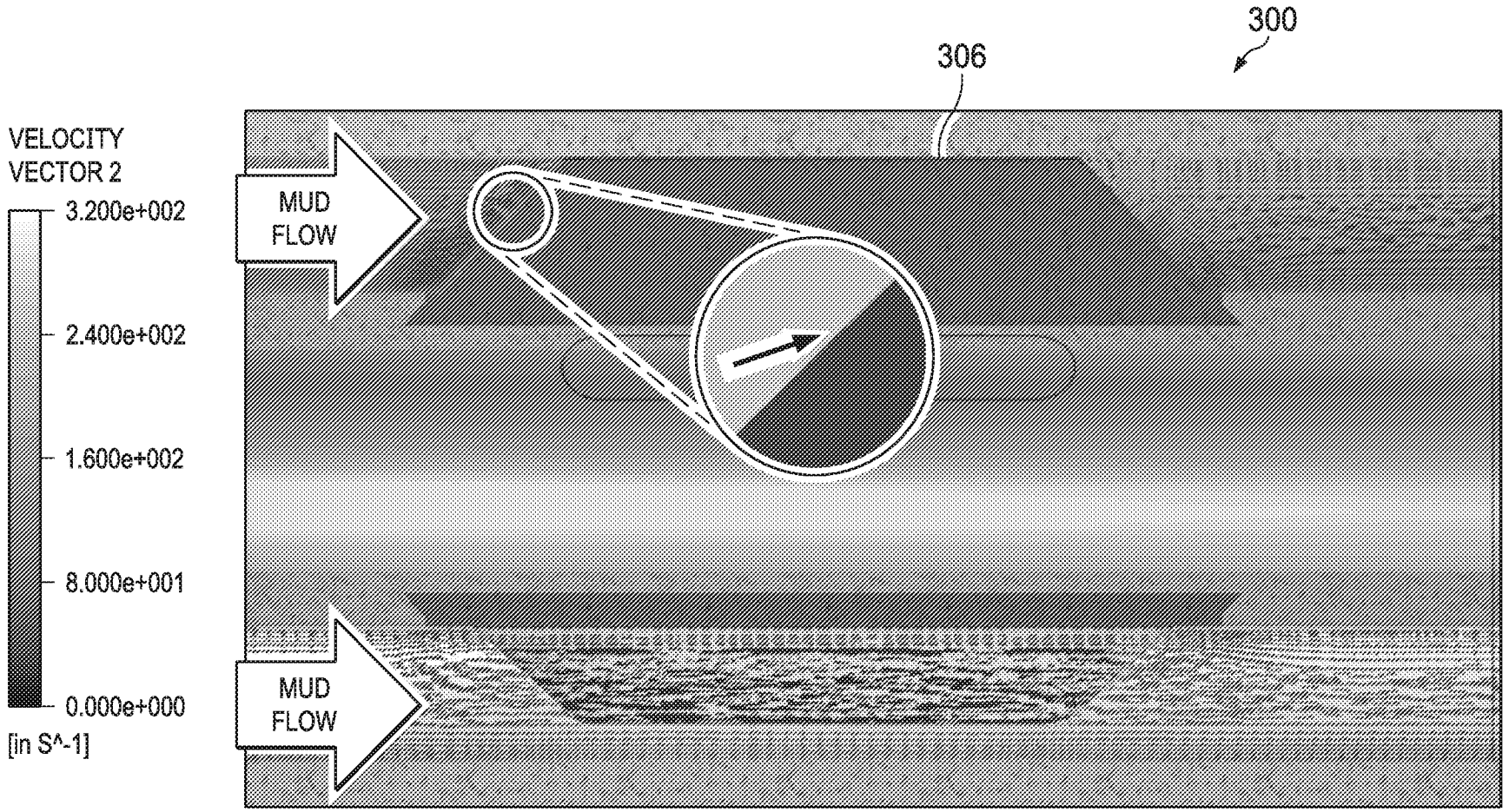
FIG. 16 is a cross-sectional side view of a graphical representation of a computational fluid dynamics analysis of the prior art centralizer of FIG. 2.

Referring now to FIG. 16, the prior art centralizer 300 is shown along with a graphical representation of a computational fluid dynamics analysis of the prior art centralizer 300, the predicted velocity being generated using the same computational fluid dynamics model of Prior Art FIG. 4. FIG. 16 demonstrates with a zoomed view of the fin 306 and shows that the zoomed view of the fin 306 is experiencing a scouring flow of particulate matter against the fin 306. FIG. 16 further identifies examples of impingement zones, dead zones, and zones of funneled flow.

Figure 17:
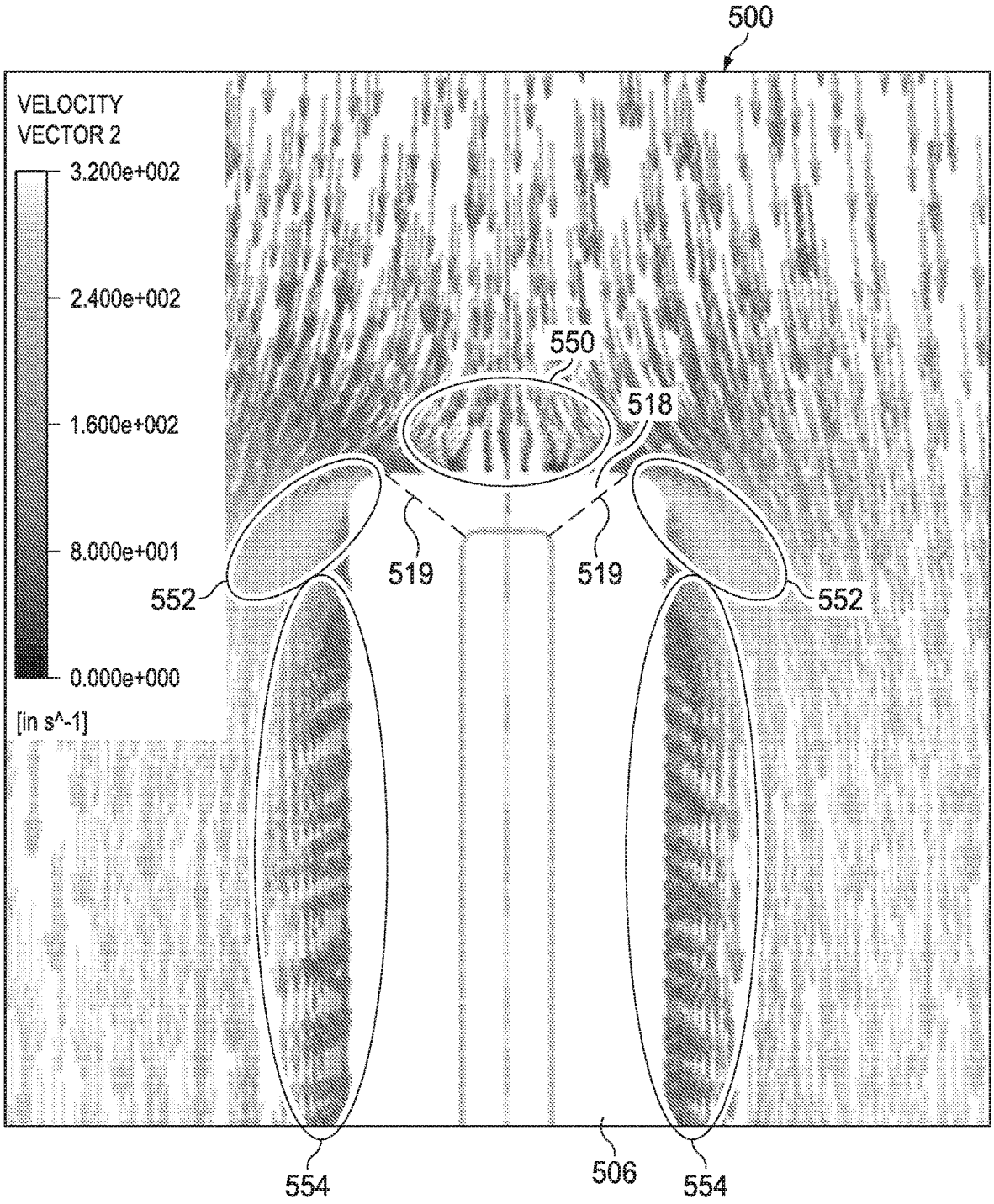
FIG. 17 is a view of a graphical representation of a computational fluid dynamics analysis of the centralizer of FIG. 10, showing flow stagnation, turbulence, and flow separation.

Referring now to FIG. 17, the centralizer 500 is shown along with a graphical representation of a computational fluid dynamics analysis of the centralizer 500, the predicted velocity being generated using the same computational fluid dynamics model of FIG. 13. However, FIG. 17 demonstrates a decelerated zone 550 that is attributable to the impact with the impact surface 518, turbulent shed zones 552 that demonstrate the purposefully induced turbulent flow, and separation zones 554 that result from the flow separating form the fin 506 as a result of the turbulent flow. A disadvantage associated with conventional elastomer fin designs is that erosive particulate material breaks down the leading edge (e.g., the transition between impact surface and side surfaces) and begins the erosive decay of the fin 506. The design of the fins 506 disclosed herein is counterintuitive for most fluid flow circumstances, since it introduces drag and turbulence. As described above, by altering the flow, the erosive material is forced away from the immediate area around the leading edges. Some erosive material is caught in the fluid flow stream not impacting the fin and the remainder does not form a laminar flow with the fin surface until it is away from the leading edge. This management of the fluid flow significantly increases the erosion life of the fin 500 as compared to the prior art fins 300 that do not have blunt impact surfaces.

Figure 18:
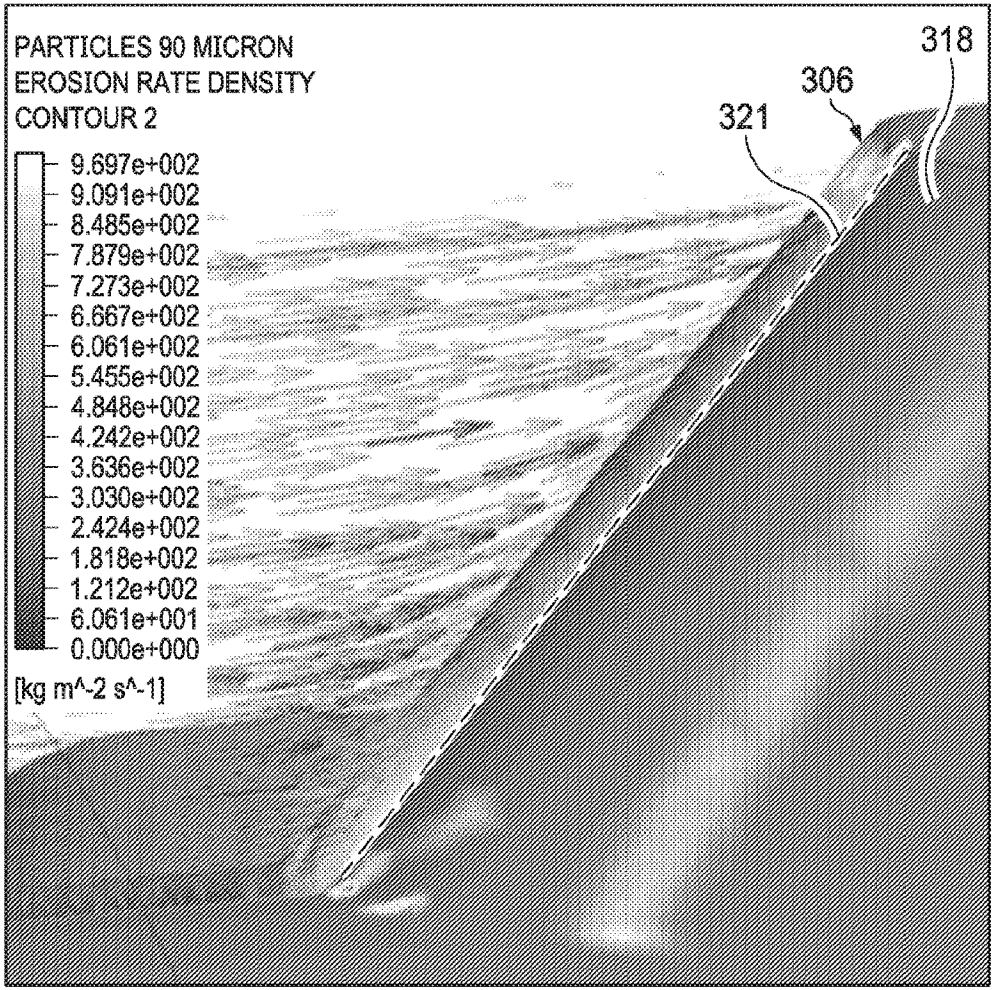
FIG. 18 is a view of a graphical representation of a computational fluid dynamics analysis of the prior art centralizer of FIG. 2, showing an unimpeded erosion rate density.

Referring now to FIG. 18, the prior art centralizer 300 is shown along with a graphical representation of a computational fluid dynamics analysis of the prior art centralizer 300, the predicted erosion rate density being generated using the same computational fluid dynamics model of FIG. 4. FIG. 18 demonstrates that, as fluid contacts the fin 306 along the angular bisection line 321 of the upstream longitudinal end 318, the fluid is forced to change direction but nonetheless maintains a significant velocity and resultant erosion rate density along the fin 306.

Figure 19:
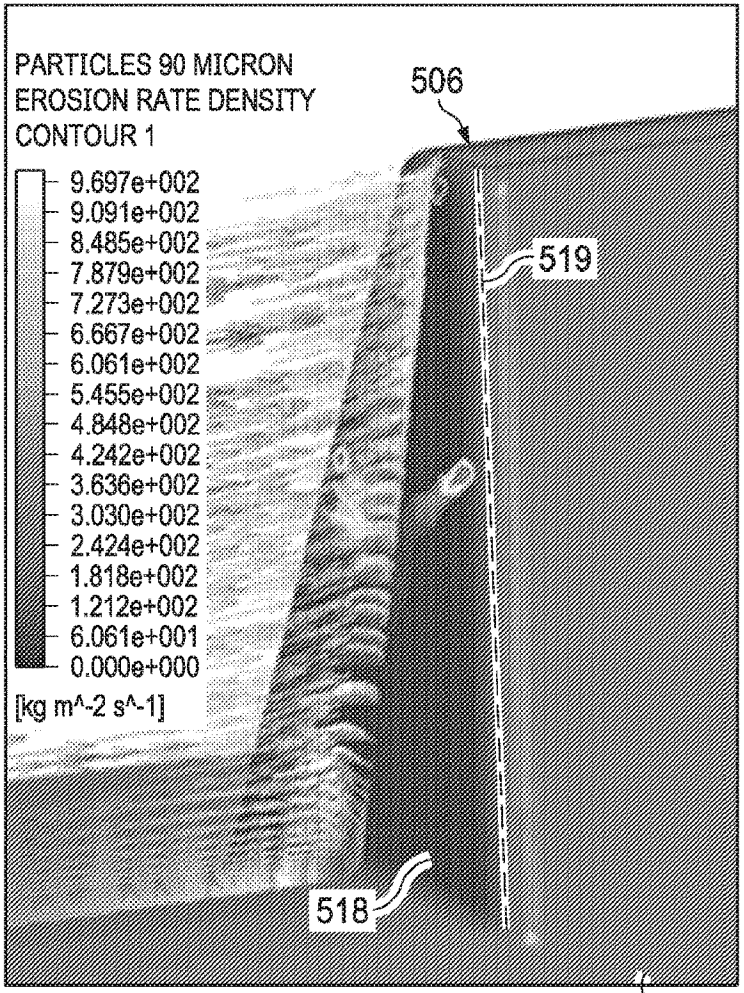
FIG. 19 is a view of a graphical representation of a computational fluid dynamics analysis of the centralizer of FIG. 10, showing a reduced erosion rate density.

Referring now to FIG. 19, the centralizer 500 is shown along with a graphical representation of a computational fluid dynamics analysis of the prior art centralizer 300, the predicted erosion rate density being generated using the same computational fluid dynamics model of FIG. 13. In comparison to FIG. 18, FIG. 19 shows that, because of the blunt impact of the fluid flow upon encountering the impact surface 518, fluid velocity and, therefore, the resultant erosion rate density along the impact surface are much less than the erosion rate density of the conventional fin 306.

Figure 20:
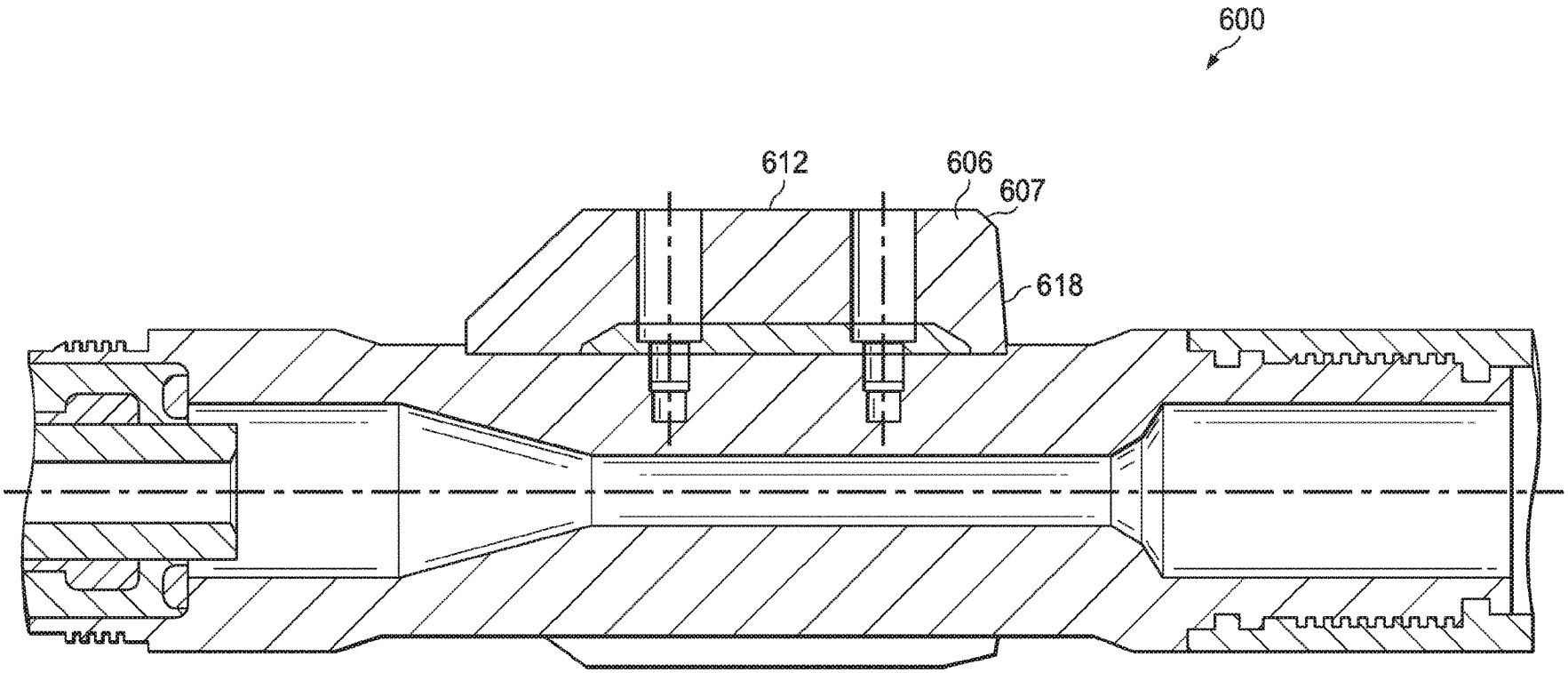
FIG. 20 is a cross-sectional side view of a third example embodiment of a centralizer.

Referring now to FIG. 20, a fin 606 of a centralizer, generally designated 600, is shown. Fin 606 is substantially similar to fin 506, shown in FIGS. 10 to 12. Fin 606 differs from fin 506 due to the presence of a chamfered transition surface 607 arranged between and connecting the impact surface 618 and the wall interface 612, such that the chamfered transition surface 607 has a larger angle (e.g., is more inclined) than the upstream angle (see 522, FIG. 11) of the impact surface 518. The chamfered transition surface 607 is advantageous in that the fin 606 may be more easily retrieved from a downhole installation (e.g., in borehole 104, FIG. 1) than for the fin 506. The provision of the chamfered transition surface 607 does not cause substantially greater erosive wear (e.g., does not reduce the wear life by more than 5%, 10%, 20%, or 30%, depending on the shape, position, orientation, and size of the chamfered transition surface 607 relative to the impact surface 618 of the fin 606) on the surfaces of the fin 606.

Figure 21:
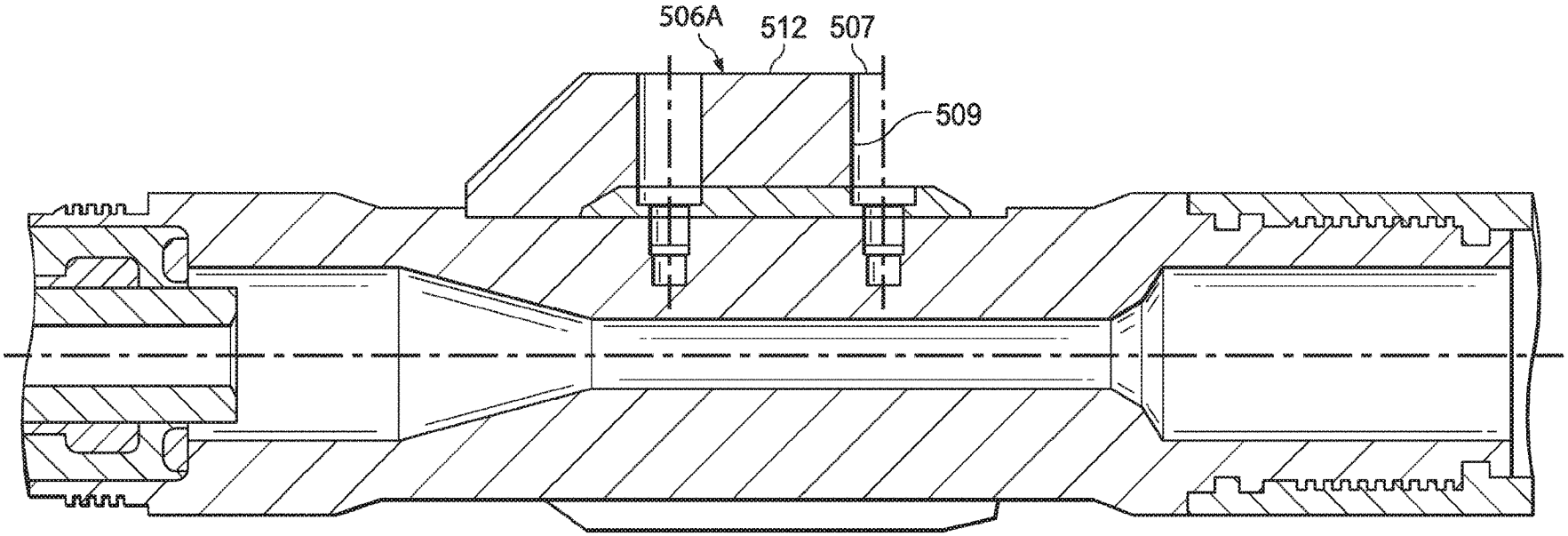
FIG. 21 is a cross-sectional side view of a fourth example embodiment of a centralizer.

Referring now to FIG. 21, a damaged fin, generally designated 506A, is shown. The damaged fin 506A illustrates that, after some attempts at insertion, retrieval, and or movement of the fin in a downhole installation (e.g., within the a borehole 104, FIG. 1), some portions of the fin 506 may become structurally compromised and fracture, crack, chip, or otherwise break off. In some cases, the broken off portion of the fin 506 may be carried away with the fluid flowing past the damaged fin 506A substantially immediately after the damage occurs. FIG. 21 illustrates that even if an upstream portion (e.g., having the impact surface 518 originally formed on an external, upstream-facing surface thereof) of the fin 506, between the original impact surface 518 and an upstream installation bolt aperture 507 is removed, the fin 506 may have a redundant impact surface 509 that is only exposed to the erosive flow as an impact surface upon damage to, or removal of (e.g., by fracture or breaking off) the original impact surface 518 of the fin 506. Upon removal of the original impact surface 518, the redundant impact surface 509 is consequently exposed to oncoming fluid flow. Although the redundant impact surface 509 may perform better than a streamlined or smooth interface, such as the upstream longitudinal end 318 of the prior art centralizer 300 (FIGS. 2 and 3), the redundant impact surface 509 may not provide degraded erosion prevention performance compared to the erosion prevention performance of the original impact surface 518.

Figure 22:
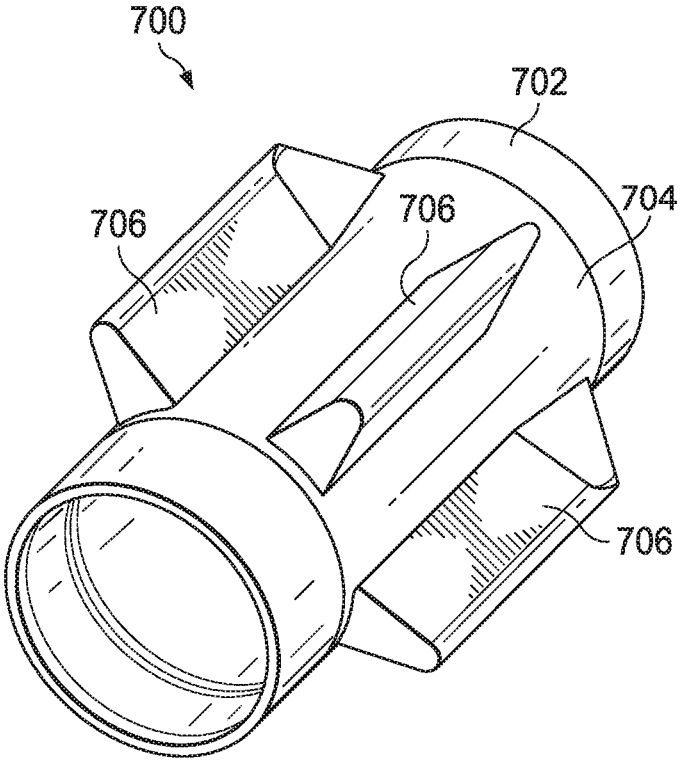
FIG. 22 is an upstream oblique view of a fifth example embodiment of a centralizer.
Figure 23:
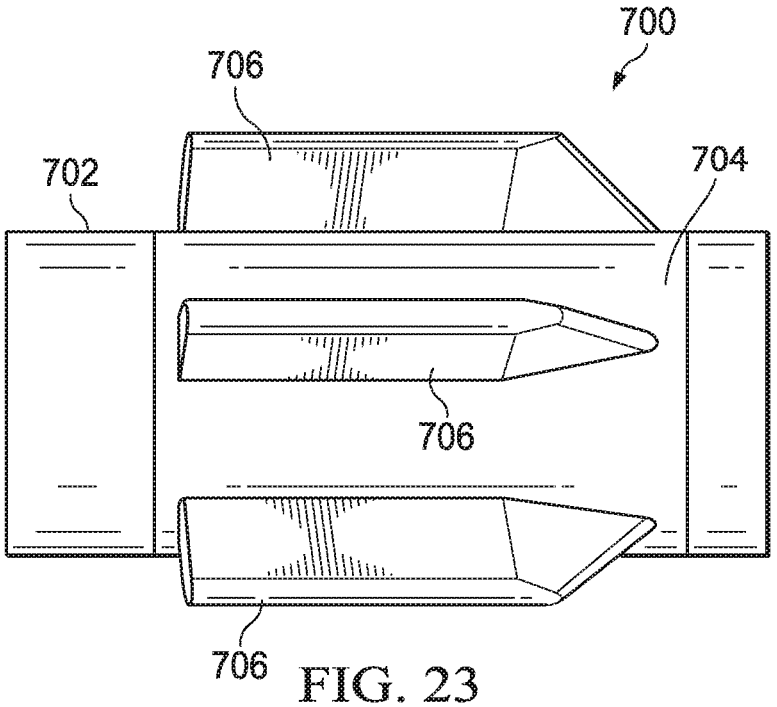
FIG. 23 is a side view of the centralizer of FIG. 22
Figure 24:
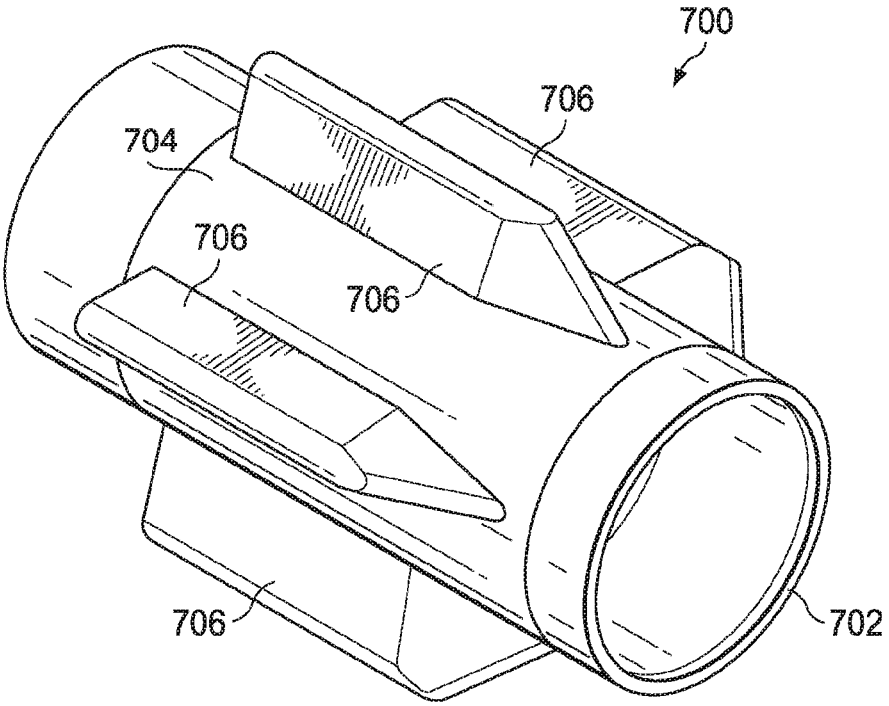
FIG. 24 is an oblique view of the centralizer of FIG. 22.
Figure 25:
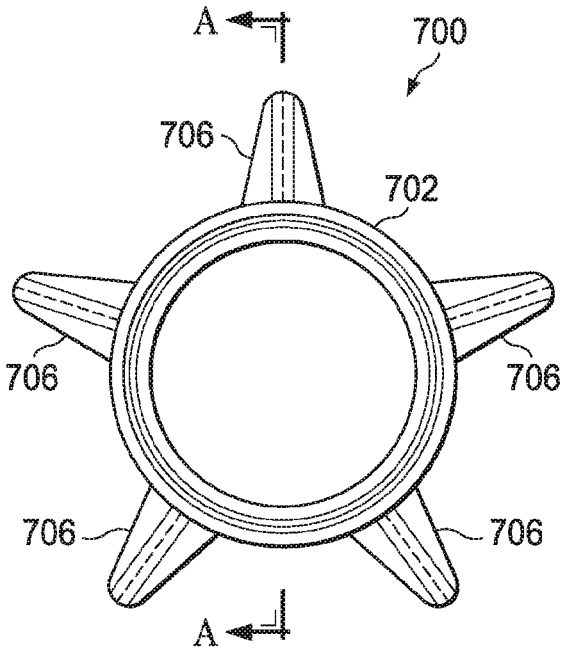
FIG. 25 is a top view of the centralizer of FIG. 22.
Figure 26:
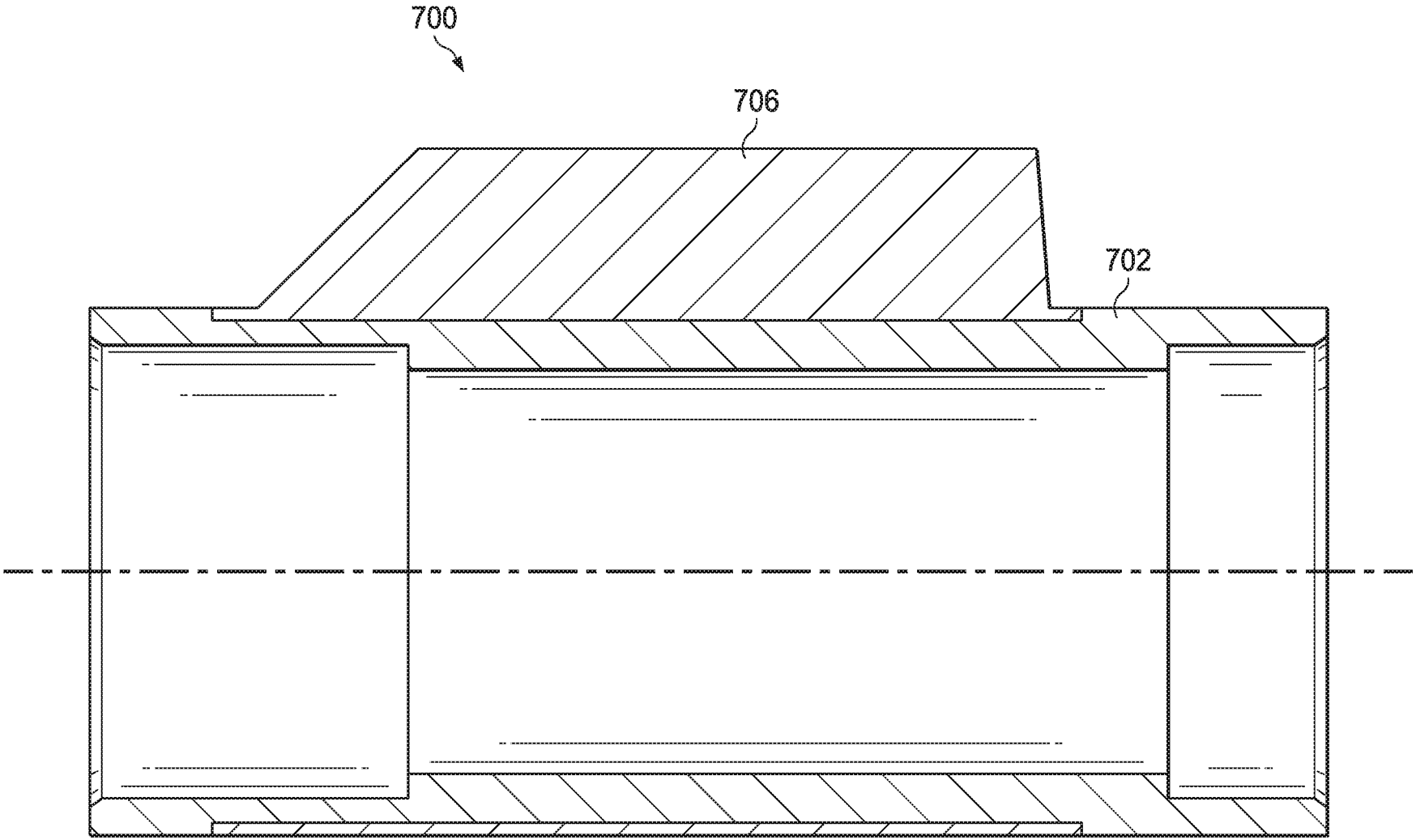
FIG. 26 is a cross-sectional side view of the centralizer of FIG. 22, taken along cutting line A-A of FIG. 25.

Referring now to FIG. 22, an upstream oblique view of a fifth example embodiment of a centralizer, generally designated 700, is shown. The centralizer 700 comprises a body 702 having a generally tubular shape (e.g., that of a hollow cylinder), with a central reduced outside diameter section 704 arranged between flange sections arranged longitudinally on both opposing ends of the reduced outside diameter section 704. In some embodiments, the reduced outside diameter section 704 may be in the form of a cylindrical band wrapped circumferentially around the body 702, such that an outer surface of the reduced outside diameter section 704 is substantially the same (e.g., within about 10%, within about 5%, within about 1%, etc.) as the outer diameter of the body 702. The fins 706 may be attached to either the body or the reduced outside diameter section 704, including when the reduced outside diameter section 704 is in the form of a cylindrical band or tubular carrier, for example, using fasteners, welding, additive manufacturing, injection molding, and the like. In some embodiments, the reduced outside diameter section 704 is made from a same material as the fins 706. In some embodiments, the reduced outside diameter section 704 is made of a same material as the body 702. A plurality of fins, generally designated 706, are shown attached circumferentially to and about the reduced outside diameter section 704 of the centralizer 700, such that the fins are evenly spaced (e.g., having a substantially uniform fin pitch) about the reduced outside diameter section 704 and extend radially outwardly away from the reduced outside diameter section 704. Like with fin 506, fin 706 is configured to similarly cause a localized reduction in velocity of fluid flow, and particularly of particulate matter entrained in the fluid flow, that contacts the fin 706 and to similarly cause turbulent fluid shedding from the impact surfaces of the fin 706. FIG. 23 shows a side view of the centralizer 700. FIG. 24 shows a downstream oblique view of the centralizer 700. FIG. 25 shows a downstream end view of the centralizer 700. FIG. 26 shows a cross-sectional view of the centralizer 700, through one of the fins 706, the cross-sectional view being taken along cutting line A-A of FIG. 25.

Figure 27:
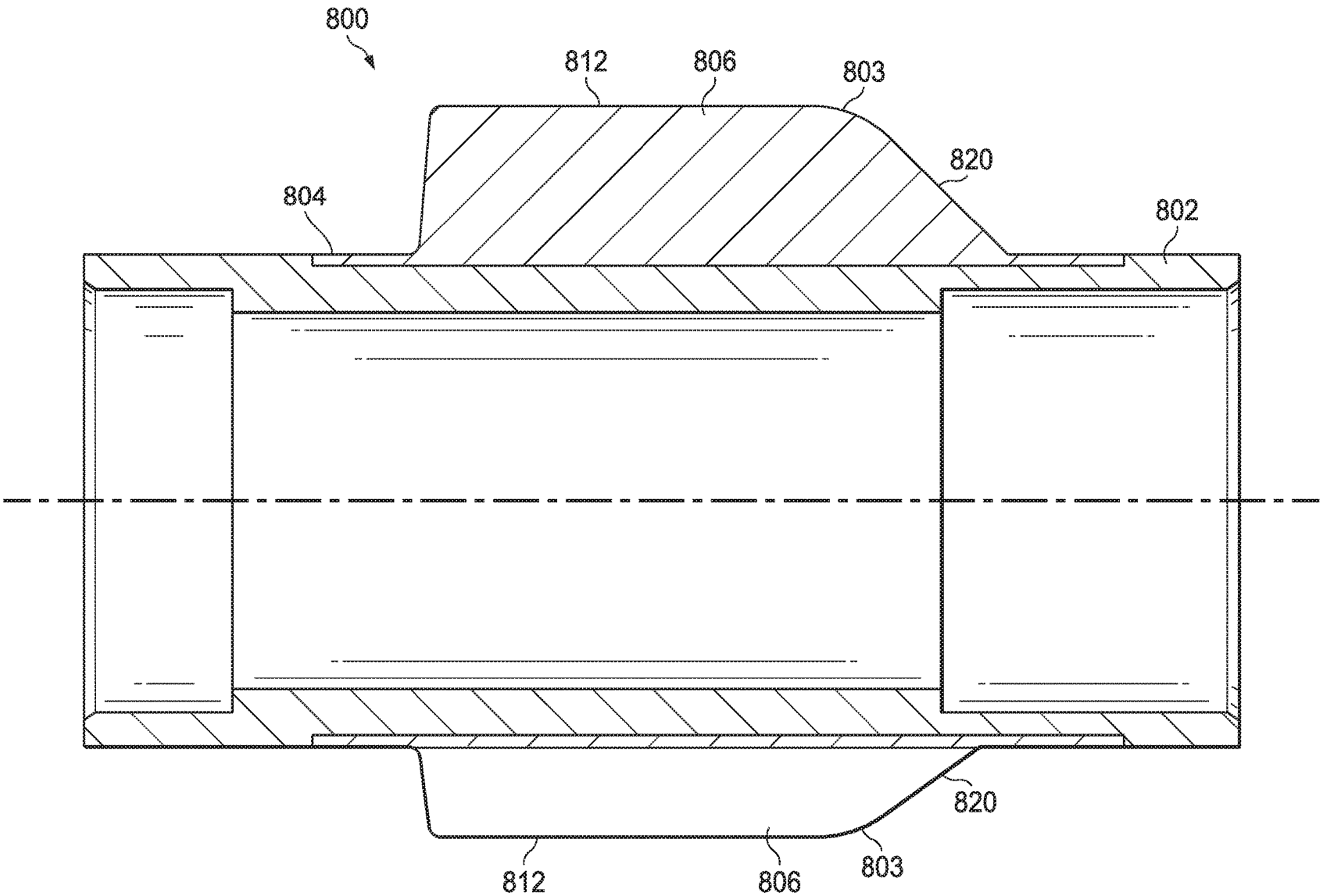
FIG. 27 is a cross-sectional side view of a sixth example embodiment of a centralizer.

Referring now to FIG. 27, an alternative embodiment of example embodiment of a centralizer, generally designated 800, is shown. The centralizer 800 comprises a body 802 having a generally tubular shape (e.g., that of a hollow cylinder). In some embodiments, the centralizer 800 can have a central reduced outside diameter section (e.g., such as 704, FIGS. 22-26) arranged between flange sections arranged longitudinally on both opposing ends of the reduced outside diameter section. A plurality of fins, generally designated 806, are shown attached circumferentially to and about the body 802, such that the fins are evenly spaced (e.g., having a substantially uniform fin pitch) about the body 802 and extend radially outwardly away from the body 804. The fins 806 notably differ from other fins disclosed herein (e.g., 406, 506, 606, 706) by comprising a curved transition 803 between the wall interface 812 and the downstream tail surface 820.

While the centralizers and associated fins described herein have been disclosed as being utilized with a hydrocarbon recovery system such as hydrocarbon recovery system 100, any such centralizers and fins, as well as combinations thereof, that are disclosed herein may be used in conjunction with any other suitable systems without deviating from the scope of the subject matter disclosed herein.

In particular, the disclosed centralizers (400, 500, 600, 700, 800) and fins (406, 506, 606, 706, 806) can be utilized in conjunction with a coiled tubing drilling system. The coiled tubing drilling system can comprise a reel carrying a roll of coiled tubing, a guide to help bend the coiled tubing through an injector and associated pressure containment device, an orienting device near a downhole end of the coiled tubing, data sensors near the downhole end of the coiled tubing, a motor near the downhole end of the coiled tubing, and a drilling bit. One or more of the coiled tubing, orienting device, data sensors, motor, and drilling bit may benefit from either carrying or being associated with (e.g., attached to) the centralizers (400, 500, 600, 700, 800) and/or fins (406, 506, 606, 706, 806) disclosed herein. The centralizers and/or fins (406, 506, 606, 706, 806) disclosed herein can provide a desired centralizing and/or vibration damping effect to the coiled tubing system while still allowing the necessary fluid flow. In some cases, the centralizers and/or fins (406, 506, 606, 706, 806) disclosed herein may be longitudinally reversed so that reverse flow of fluids first impact the above-described impact surfaces of the fins (406, 506, 606, 706, 806).

Further, the centralizers and fins (406, 506, 606, 706, 806) disclosed can be utilized in conjunction with a wireline logging system. The wireline logging system can comprise a winch configured to control dispensation of a cable, a logging tool configured to be deployed downhole sometimes through a casing, and a logging unit configure to receive and record information from the logging tool. One or more of the cable and logging tool may benefit from either carrying or being associated with the centralizers (400, 500, 600, 700, 800) and/or fins (406, 506, 606, 706, 806) disclosed herein.

While some embodiments described above disclose a fin (406, 506, 606, 706, 806) being connected to a carrier (e.g., 402, 502, 602, 702, 802) by use of a bolted connection, other methods of attachment are contemplated. In particular, in alternative embodiments, a fin (406, 506, 606, 706, 806) may be connected to a carrier (402, 502, 602, 702, 802) by being bonded to the carrier (402, 502, 602, 702, 802), by using a compression fit or a slip-fit, by using a thermal fit, by using a band or a clamp, and/or by being integrally formed with the carrier (402, 502, 602, 702, 802). In some embodiments, a fin (406, 506, 606, 706, 806) may be integrally formed with a carrier (402, 502, 602, 702, 802) using an additive manufacturing process.

In some cases, the fins (406, 506, 606, 706, 806) described herein may comprise an elastomer, polyurethane, nitrile, natural rubber, ethylene propylene diene monomer rubber, a temperature resistant synthetic elastomer, and/or a fluid resistant synthetic elastomer. Further, in some cases, a fin (406, 506, 606, 706, 806) may comprise a structural constituent dispersed within the primary fin material and/or the fin (406, 506, 606, 706, 806) may comprise structural elements such as bars or plates of structural material disposed within the primary fin material.

Figure 28:
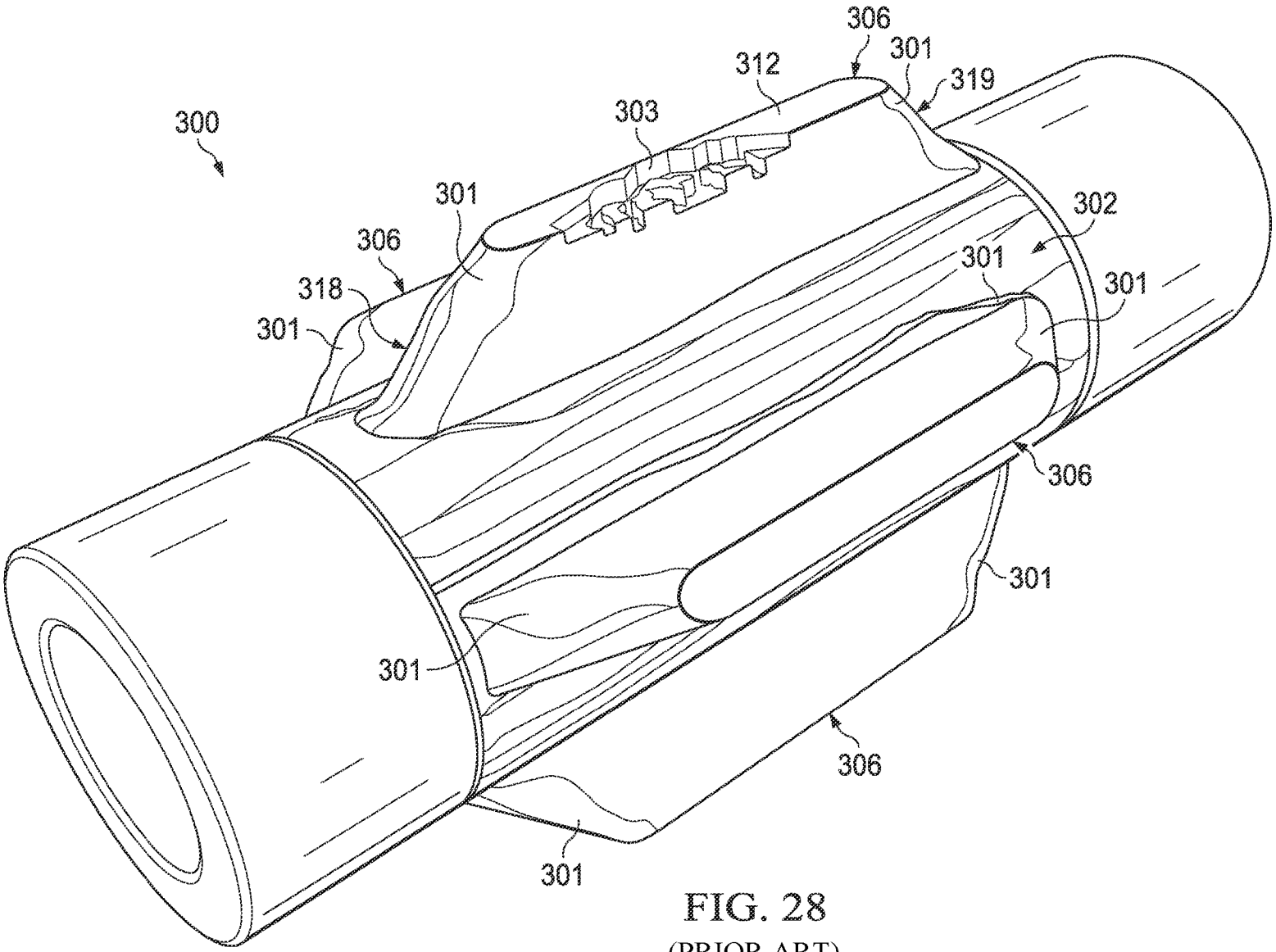
FIG. 28 (PRIOR ART)
FIG. 28 is an oblique view of the prior art centralizer of FIG. 2, after having been disposed in an abrasive flow.

Referring now to FIG. 28, the prior art centralizer 300 is shown in a condition after having been exposed to abrasive fluid flow. More specifically, the prior art centralizer 300 is shown after having been abraded and worn (e.g., eroded due to frictional impacts with particulate matter entrained in a fluid flow passing around the prior art centralizer 300) to form wash areas 301 of the fin 306 that have experienced a localized reduction in material due to the abrasive impacts of the particulate matter entrained in the fluid flow. The wash areas 301 are shown as being present on leading and trailing longitudinal ends 318, 319, respectively, of fins 306. In some cases, a wash area 301 is present on the carrier 302, between adjacent fins 306. Still further, in some cases abrasion may lead to a chunking area 303 on wall interface 312. The chunking area 303 represents a portion of the fin 306 where larger portions of the material of the fin 306 are removed relatively intact (e.g., not gradually, as is the case for erosive wear) as compared to the smoother and more gradual material removal that occurs in the wash areas 301.

Figure 29:
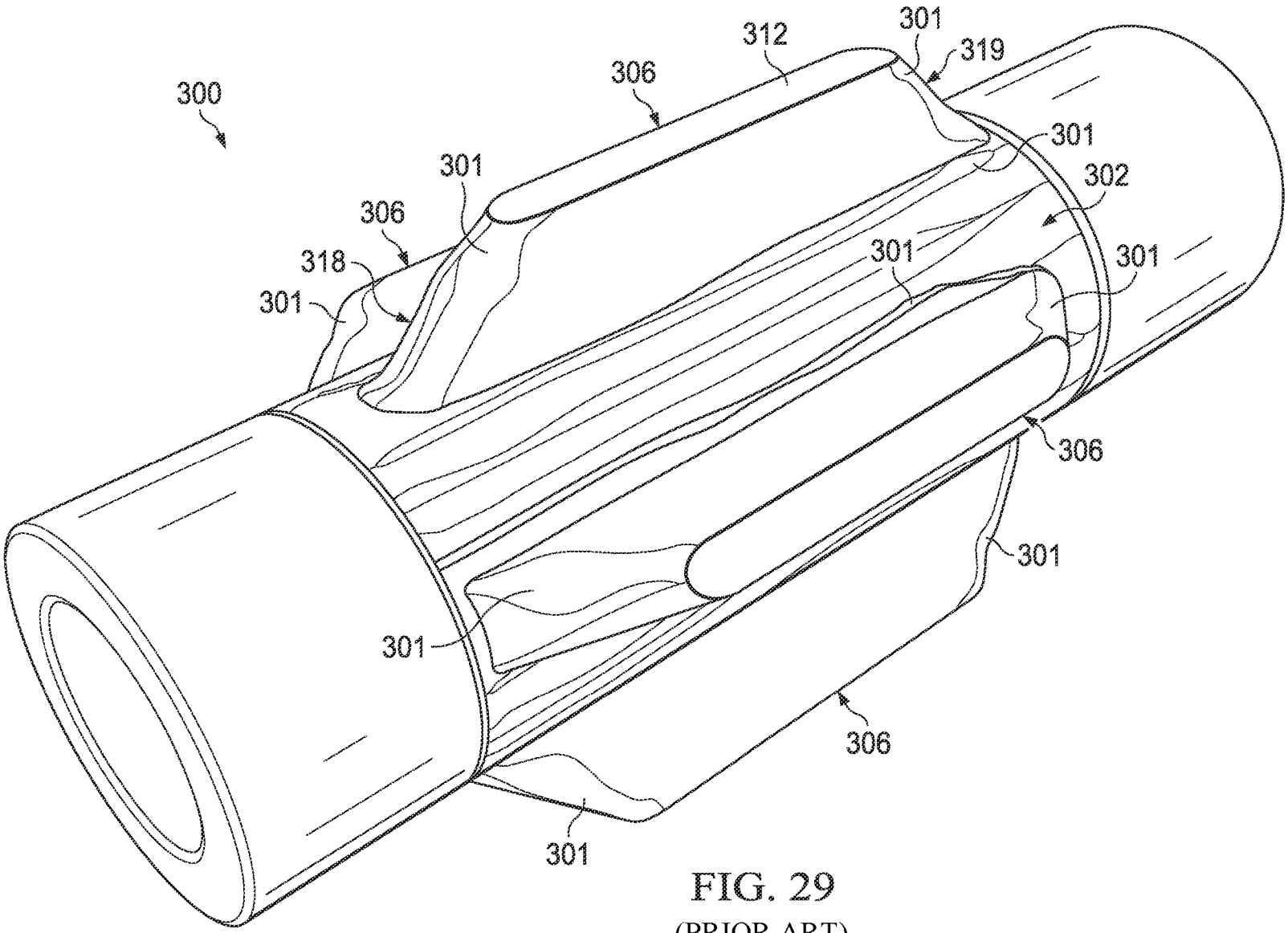
FIG. 29 (PRIOR ART)
FIG. 29 is an oblique view of the prior art centralizer of FIG. 2, after having been disposed in an abrasive flow.

Referring now to FIG. 29, the prior art centralizer 300 is shown in a condition after having been exposed to abrasive fluid flow. More specifically, the prior art centralizer 300 is shown after having been abraded and worn (e.g., eroded due to frictional impacts with particulate matter entrained in a fluid flow passing around the prior art centralizer 300) to form wash areas 301 of the fin 306 that have experienced a localized reduction in material due to the abrasive impacts of the particulate matter entrained in the fluid flow. The wash areas 301 are shown as being present on leading and trailing longitudinal ends 318, 319, respectively, of fins 306. In some cases, a wash area 301 is present on the carrier 302, between adjacent fins 306.

Figure 30:
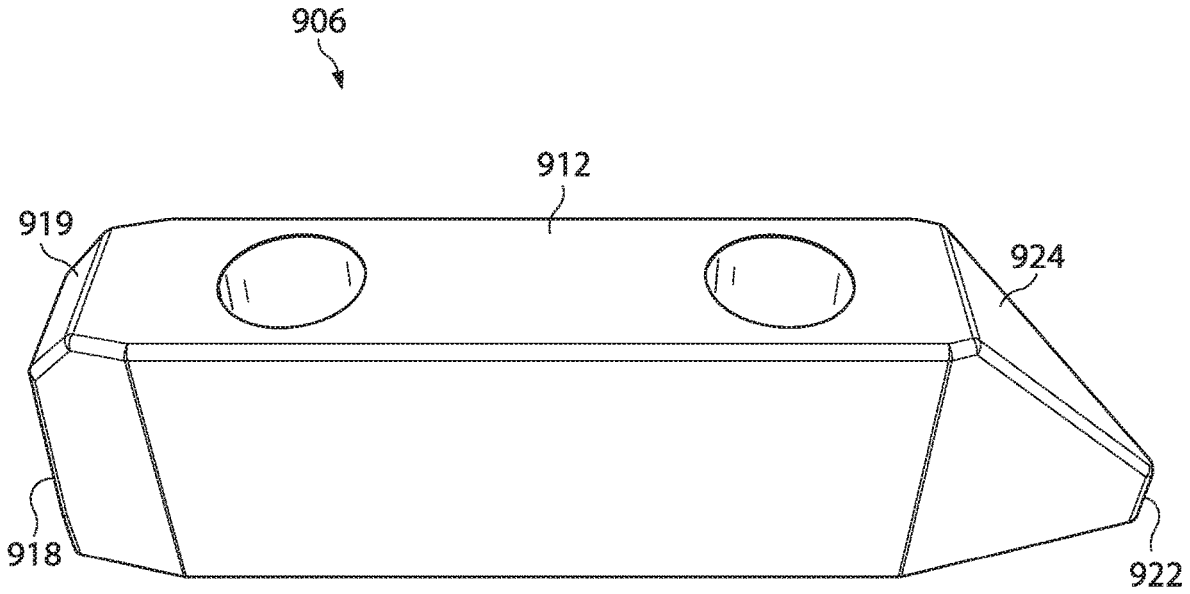
FIG. 30 is an oblique side view of a fin of a seventh example embodiment of a centralizer.
Figure 31:
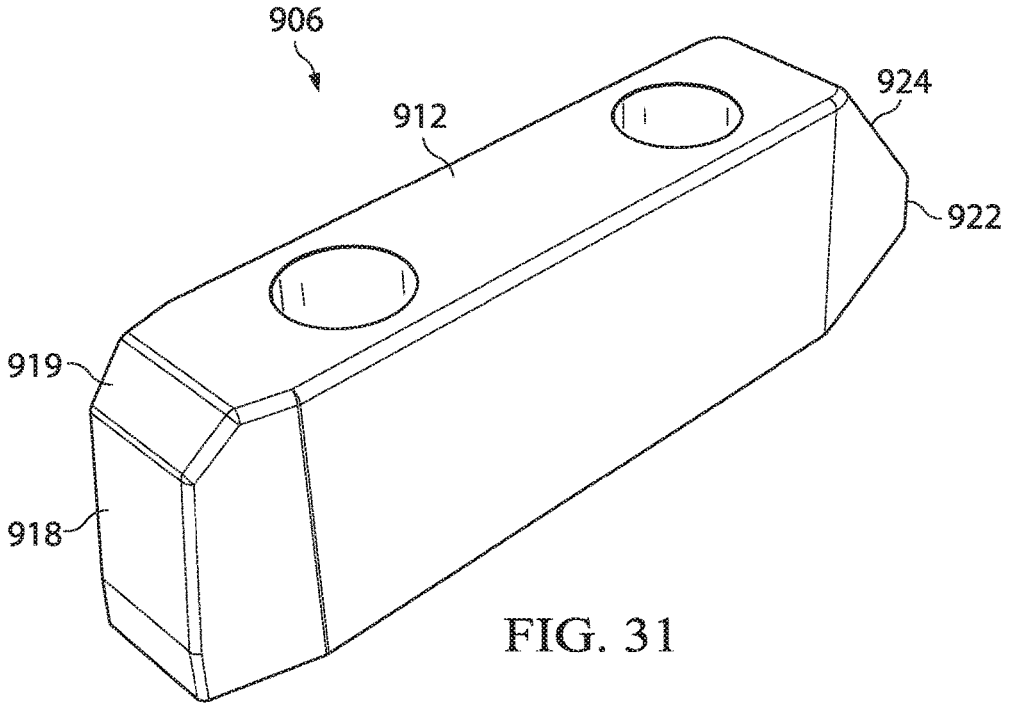
FIG. 31 is an oblique front view of the fin of FIG. 30.

Referring now to FIGS. 30 and 31, a fin, generally designated 906, according to a seventh embodiment of a centralizer is shown. The fin 906 is substantially similar to fin 406 (FIGS. 6 to 9), however, the fin 906 comprises a sloped outer transition 919 between and/or connecting an upstream impact surface 918 and a wall interface 912, such that the sloped outer transition 919 has a larger angle (e.g., is more inclined) than the upstream angle (see 522, FIG. 11) of the upstream impact surface 918. The fin 906 also comprises a radially outward downstream tail surface 924 that transitions radially inwardly toward a truncated tip surface 922 (e.g., so that the trailing portion of the fin 906 has a tapering, or thinning, profile in the radial and/or circumferential directions).

Figure 32:
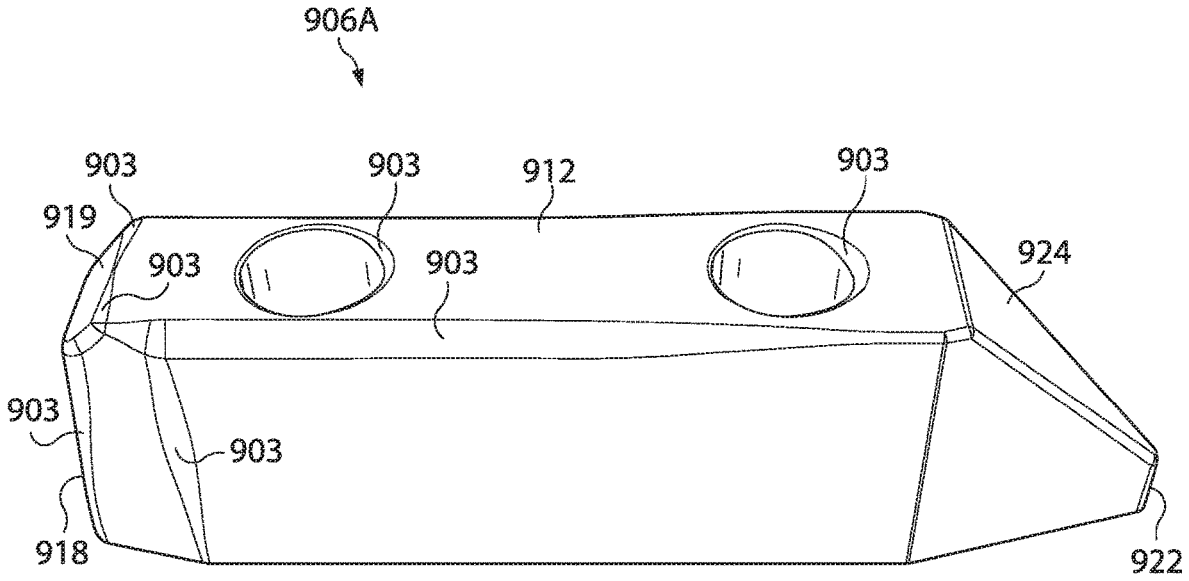
FIG. 32 is an oblique side view of the fin of FIG. 30, after having been disposed in an abrasive flow.
Figure 33:
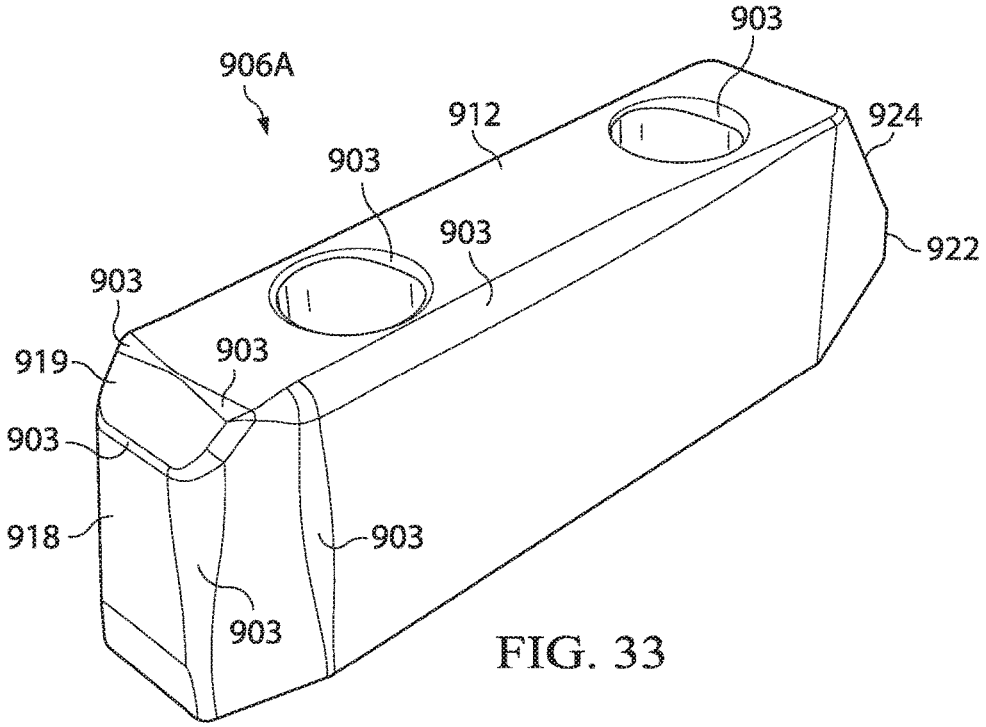
FIG. 33 is an oblique front view of the fin of FIG. 30, after having been disposed in an abrasive flow.

Referring now to FIGS. 32 and 32, a damaged fin, generally designated 906A, is shown in a condition after having been exposed to (e.g., immersed in) abrasive fluid flow over a period of time. Prior to being exposed to the abrasive fluid flow, the damaged fin 906A was substantially identical to the fin 906 of FIGS. 30 and 31. More specifically, the damaged fin 906A has been abraded and worn (e.g., eroded due to frictional impacts with particulate matter entrained in a fluid flow passing around the fin 906 of FIGS. 30 and 31) to form wash areas 903 of the damaged fin 906A that have experienced a localized reduction in material due to the abrasive impacts of the particulate matter entrained in the fluid flow. The wash areas 903 are shown as being present primarily at transitions (e.g., edges) between the upstream impact surface 918 and surfaces adjacent to (e.g., contiguous with) the upstream impact surface 918 and between the sloped outer transition 919 and surfaces adjacent to (e.g., contiguous with) the sloped outer transition 919. Wash areas 703 are also present around the entrances of mounting holes, which are formed on the wall interface 912 and/or through the thickness of the damaged fin 906A in the radial direction of the centralizer to which the damaged fin 906A is attached, and between the wall interface 912 and surfaces adjacent to (e.g., contiguous with) the wall interface 912.

Other embodiments of the current invention will be apparent to those skilled in the art from a consideration of this specification or practice of the invention disclosed herein. Thus, the foregoing specification is considered merely exemplary of the current invention with the true scope thereof being defined by the following claims.

What is claimed is:

1. A fin for use in a centralizer configured to be disposed in an abrasive fluid flow, the fin comprising:

a first end, which is oriented to face in an upstream direction of the abrasive fluid flow;

a second end, which is oriented to face in a downstream direction of the abrasive fluid flow;

a wall interface, which extends between the first end and the second end, the wall interface being configured as a contact surface of the centralizer to resist radial movements of the centralizer;

a carrier interface, which extends between the first end and the second end and is offset from the wall interface in a radially inward direction;

an impact surface, which extends between the wall interface and the carrier interface at the first end of the fin and comprises a substantially flat portion configured to stagnate the abrasive fluid flow; and one or more side surfaces, which extends between the impact surface, the wall interface, and the carrier interface;

wherein the impact surface is joined to the side surface at an edge having an edge profile configured to cause turbulence and/or separation of the abrasive fluid flow from one or more of the wall interface and the one or more side surfaces of the fin.

2. The fin of claim 1, wherein an angle between the substantially flat portion of the impact surface and a radial line extending orthogonal to a central axis of the centralizer from an end of the wall interface that is furthest in the upstream direction forms an angle within a range of about zero degrees to about fifteen degrees, inclusive.

3. The fin of claim 1, wherein the fin is configured to be rigidly attached to a carrier at the carrier interface.

4. The fin of claim 3, wherein the fin is configured for attachment to the carrier by a bolt.

5. The fin of claim 3, wherein the fin is configured for bonding to the carrier.

6. The fin of claim 3, wherein the fin is configured for attachment to the carrier using a compression fit or slip-fit.

7. The fin of claim 3, wherein the fin is configured for attachment to the carrier using a thermal fit.

8. The fin of claim 3, wherein the fin is configured for attachment to the carrier using a band or a clamp.

9. The fin of claim 3, wherein the fin is configured such that the fin and the carrier are integrally formed together.

10. The fin of claim 1, comprising a chamfered transition surface between and/or connecting the impact surface and the wall interface.

11. The fin of claim 1, wherein the fin comprises an elastomer.

12. The fin of claim 1, wherein the fin comprises polyurethane.

13. The fin of claim 1, wherein the fin comprises nitrile.

14. The fin of claim 1, wherein the fin comprises natural rubber.

15. The fin of claim 1, wherein the fin comprises ethylene propylene diene monomer rubber.

16. The fin of claim 1, wherein the fin comprises a temperature and fluid resistant synthetic elastomer.

17. The fin of claim 1, wherein the fin comprises an internal reinforcement material or reinforcement structure.

18. A centralizer configured to be disposed in an abrasive fluid flow, the centralizer comprising:

a body having a central axis extending along a length of the body;

a plurality of fins arranged circumferentially about and attached to the body, at least one of the plurality of fins comprising:

a first end, which is oriented to face in an upstream direction of the abrasive fluid flow;

a second end, which is oriented to face in a downstream direction of the abrasive fluid flow;

a wall interface, which extends between the first end and the second end, the wall interface being configured as a contact surface of the centralizer to resist radial movements of the centralizer;

a carrier interface, which extends between the first end and the second end and is offset from the wall interface in a radially inward direction;

an impact surface, which extends between the wall interface and the carrier interface at the first end of the fin and comprises a substantially flat portion configured to stagnate the abrasive fluid flow; and one or more side surfaces, which extends between the impact surface, the wall interface, and the carrier interface;

wherein the impact surface is joined to the side surface at an edge having an edge profile configured to cause turbulence and/or separation of the abrasive fluid flow from one or more of the wall interface and the one or more side surfaces of the fin.

19. The centralizer of claim 18, wherein the body is tubular and/or in a shape of a hollow cylinder.

20. The centralizer of claim 18, wherein the plurality of fins are arranged to have a substantially uniform fin pitch.

21. The centralizer of claim 18, wherein the centralizer is configured to be installed within an external structure, the wall interface being configured to press against an inner surface of the external structure to resist radial movements of the centralizer.

22. The centralizer of claim 21, wherein the external structure is a borehole.

23. The centralizer of claim 18, wherein each of the plurality of fins comprises the first end, the second end, the wall interface, the carrier interface, the impact surface, and the one or more side surfaces.

* * * * *